US007232277B2

(12) United States Patent
Corbitt

(10) Patent No.: US 7,232,277 B2
(45) Date of Patent: Jun. 19, 2007

(54) REMOTELY-CONTROLLED CONCRETE TOOL ASSEMBLY

(76) Inventor: Chris Corbitt, 8658 Langholm Rd., El Cajon, CA (US) 92021

( * ) Notice: Subject to any disclaimer, the term of this patent is extended or adjusted under 35 U.S.C. 154(b) by 0 days.

(21) Appl. No.: 11/131,829

(22) Filed: May 17, 2005

(65) Prior Publication Data

US 2005/0220541 A1 Oct. 6, 2005

Related U.S. Application Data

(63) Continuation-in-part of application No. 10/211,620, filed on Aug. 2, 2002, now abandoned.

(60) Provisional application No. 60/625,615, filed on Nov. 6, 2004.

(51) Int. Cl.
*E01C 19/22* (2006.01)

(52) U.S. Cl. ..... 404/112; 404/83; 404/84.1

(58) Field of Classification Search ..... 404/112, 404/118, 97, 83, 84.1
See application file for complete search history.

(56) References Cited

U.S. PATENT DOCUMENTS 4,784,519 A * 11/1988 Artzberger ..... 404/112
4,848,960 A 7/1989 Kajioka et al.
4,896,995 A 1/1990 Simmons
5,401,115 A 3/1995 Musil et al.
5,584,598 A 12/1996 Watanabe et al.
5,860,480 A 1/1999 Jayaraman et al.
5,890,833 A 4/1999 Allen et al.
6,089,786 A * 7/2000 Allen et al. ..... 404/112
6,106,193 A * 8/2000 Allen et al. ..... 404/112
6,132,134 A 10/2000 Hodgson
6,368,016 B1 4/2002 Smith et al.
2003/0215289 A1 * 11/2003 Williams ..... 404/112

OTHER PUBLICATIONS

Corbitt, Chris, "Declaration of Chris Corbitt Regarding Testing Prior to the Filing of the Present Application", Apr. 3, 2003, El Cajon, California.

* cited by examiner

*Primary Examiner*—Raymond W. Addie
(74) *Attorney, Agent, or Firm*—Steven G. Roeder; James P. Broder

(57) ABSTRACT

A concrete tool assembly (10) used on a concrete surface (16) includes a surfacing apparatus (12) including a frame (18) and one or more trowel assemblies (34A, 34B). Each trowel assembly (34A, 34B) includes one or more trowels (54). The concrete tool assembly (10) also includes a remote control unit (14) that controls movement of the trowel assemblies (34A, 34B) relative to the concrete surface (16). Further, the surfacing apparatus (12) can include a controller (24) that receives commands from the remote control unit (14). The controller (24) can control movement of at least one of the trowel assemblies (34A, 34B) relative to the surface (16). The surfacing apparatus (12) can also include a pitch mover (990) that simultaneously adjusts the pitch of each of the trowels (54) relative to the surface (16).

17 Claims, 17 Drawing Sheets

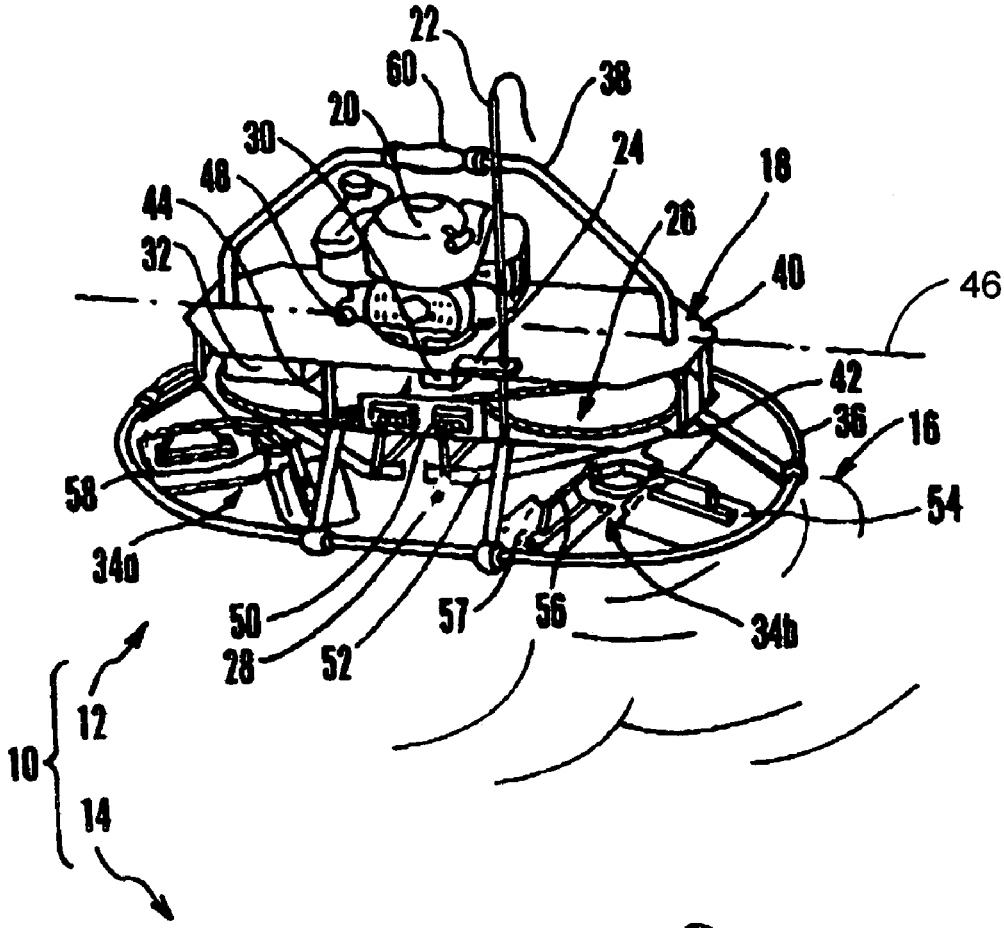
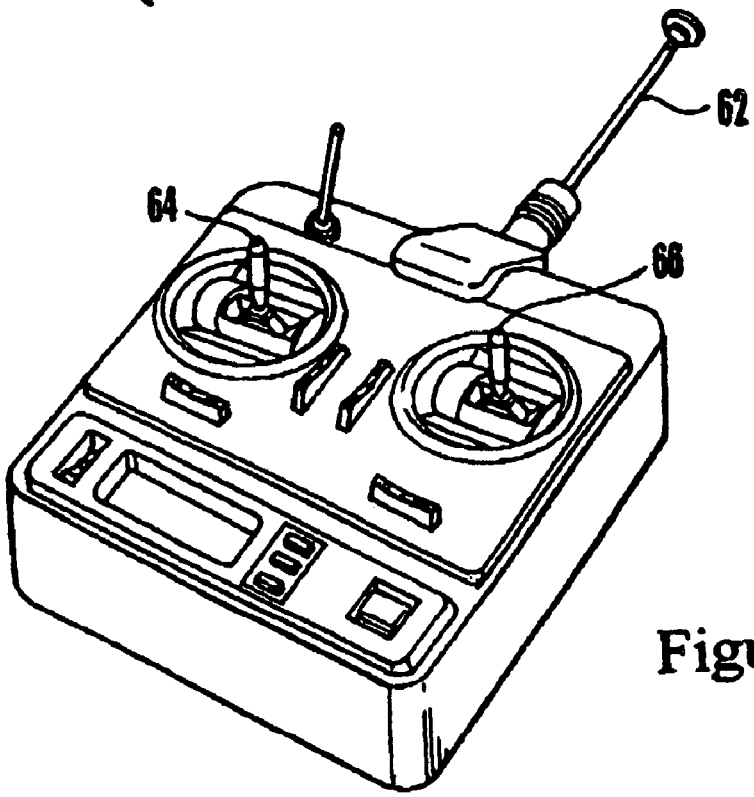
Figure 1A

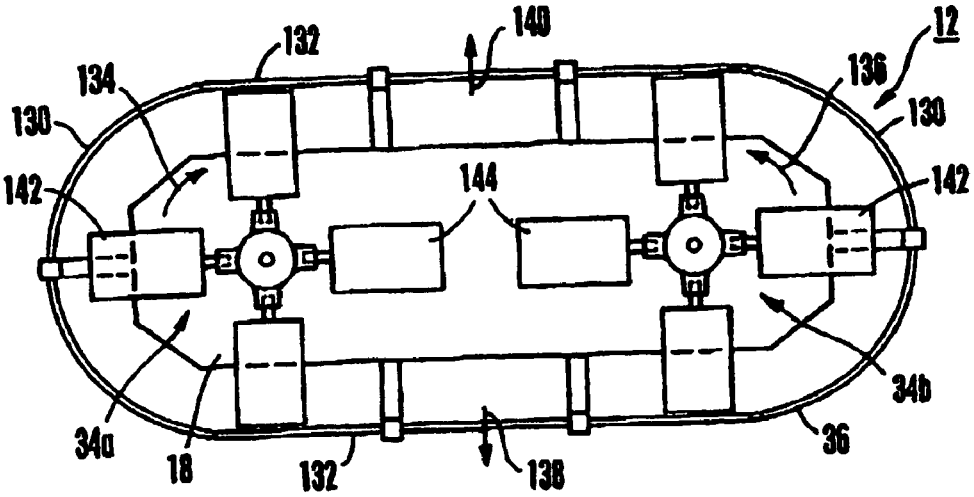
Figure 3A
Fig. 3B
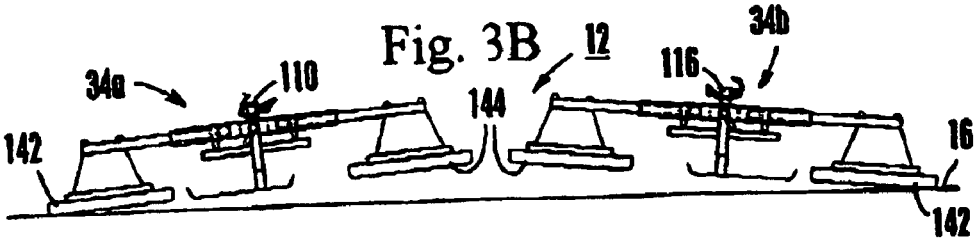
Fig. 3C
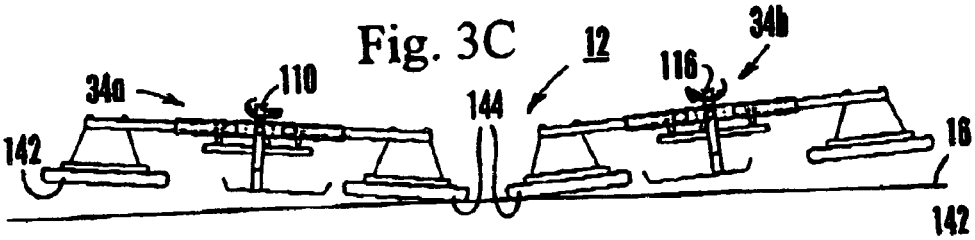
Fig. 3D
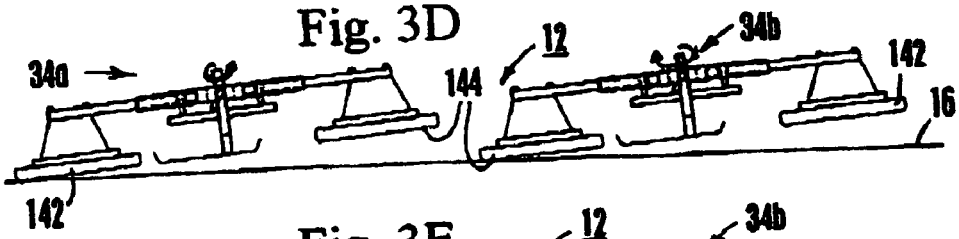
Fig. 3E
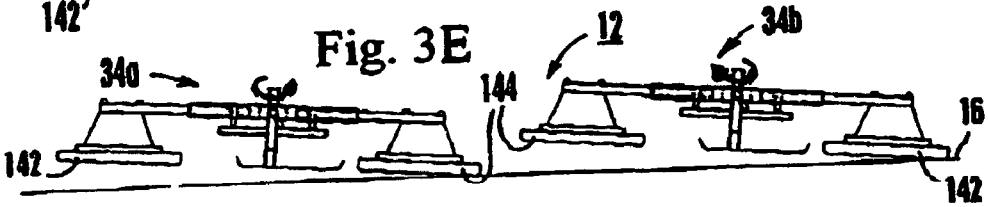

Fig. 3F
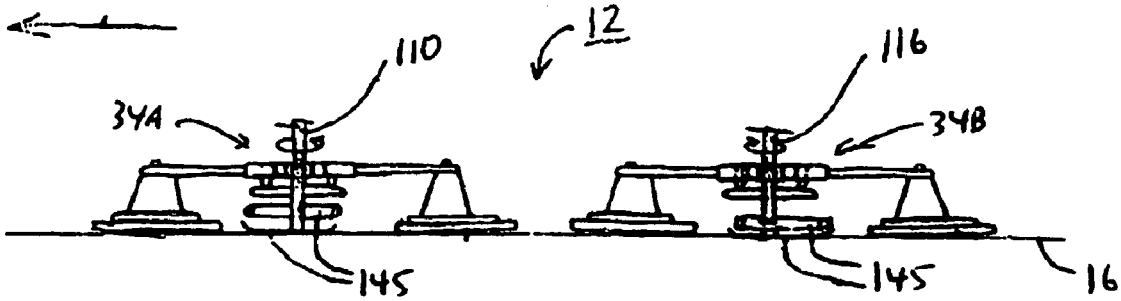
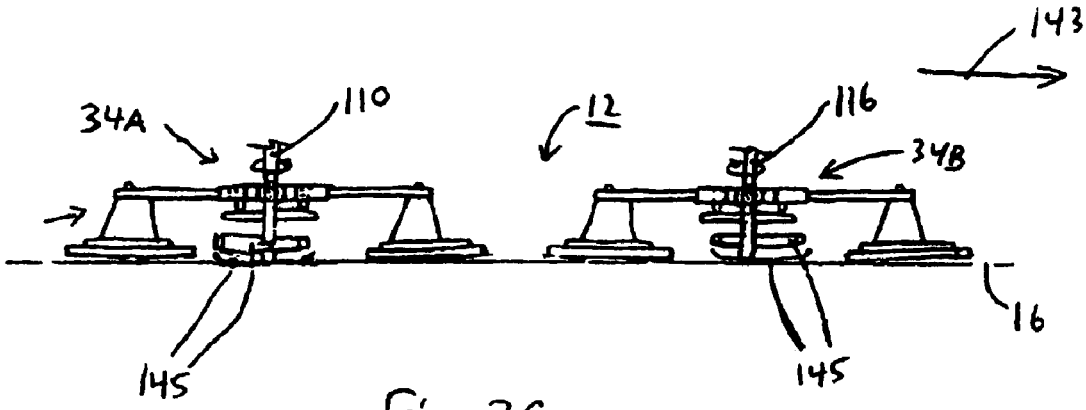
Fig. 3G

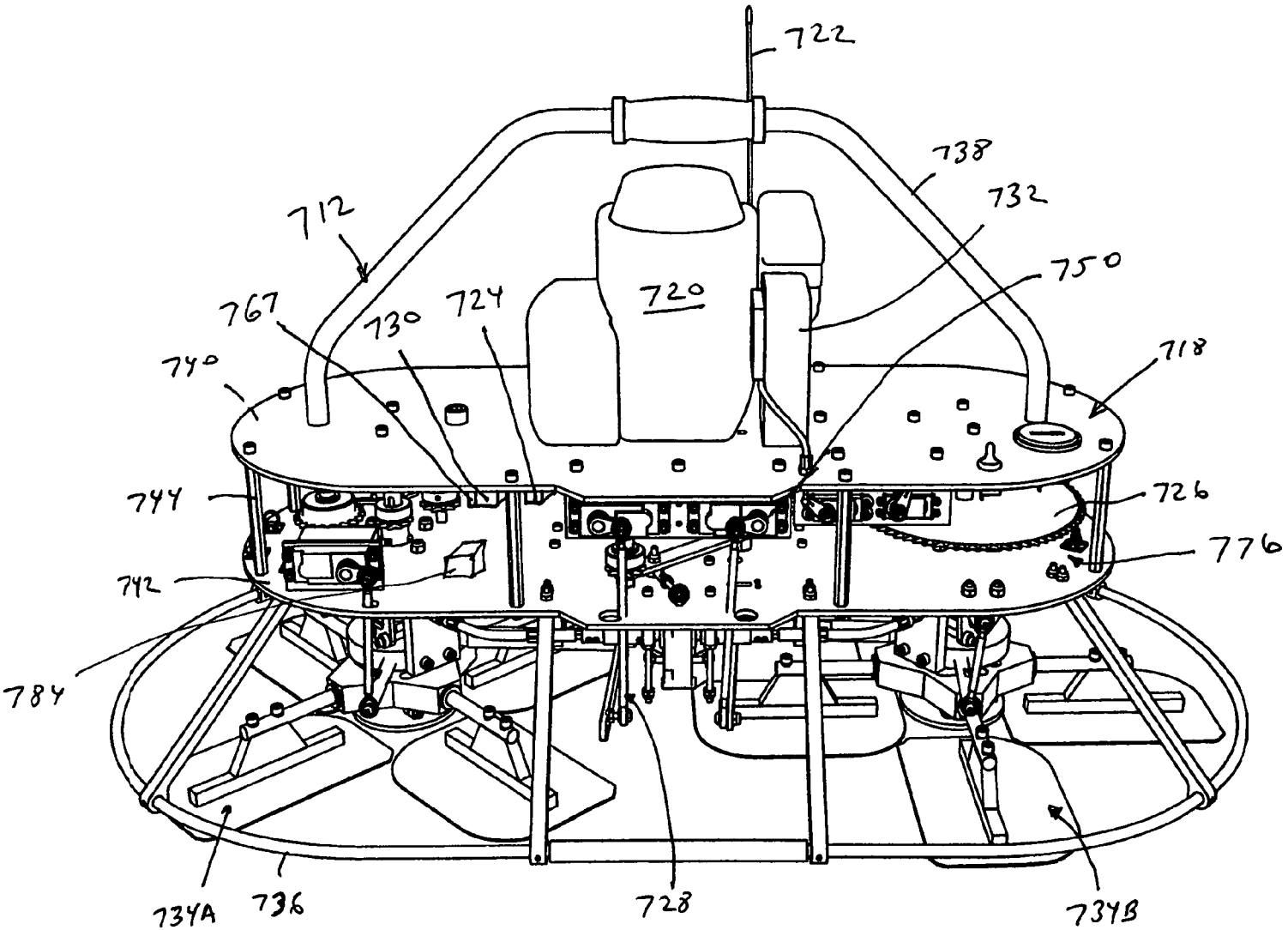
F. 6 7C

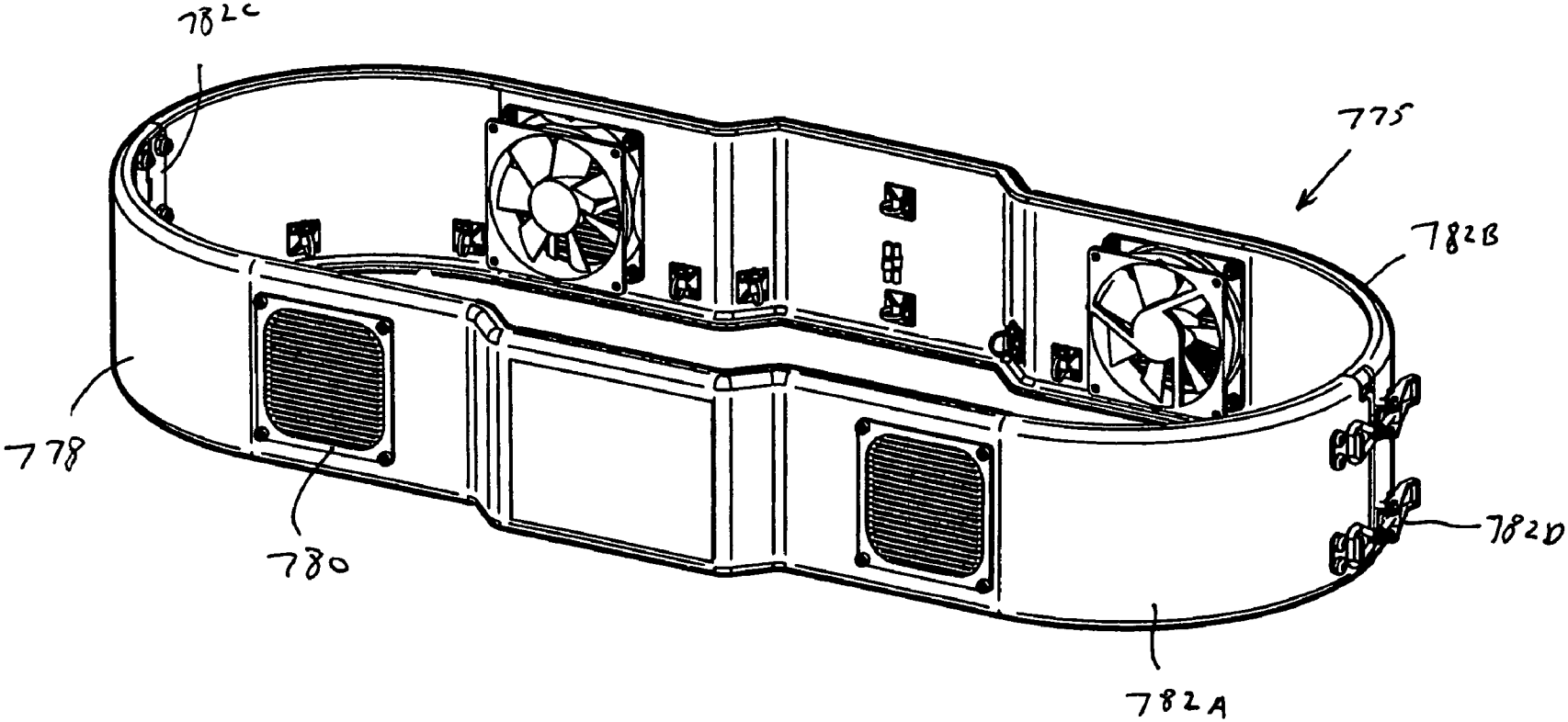
F.G. 8

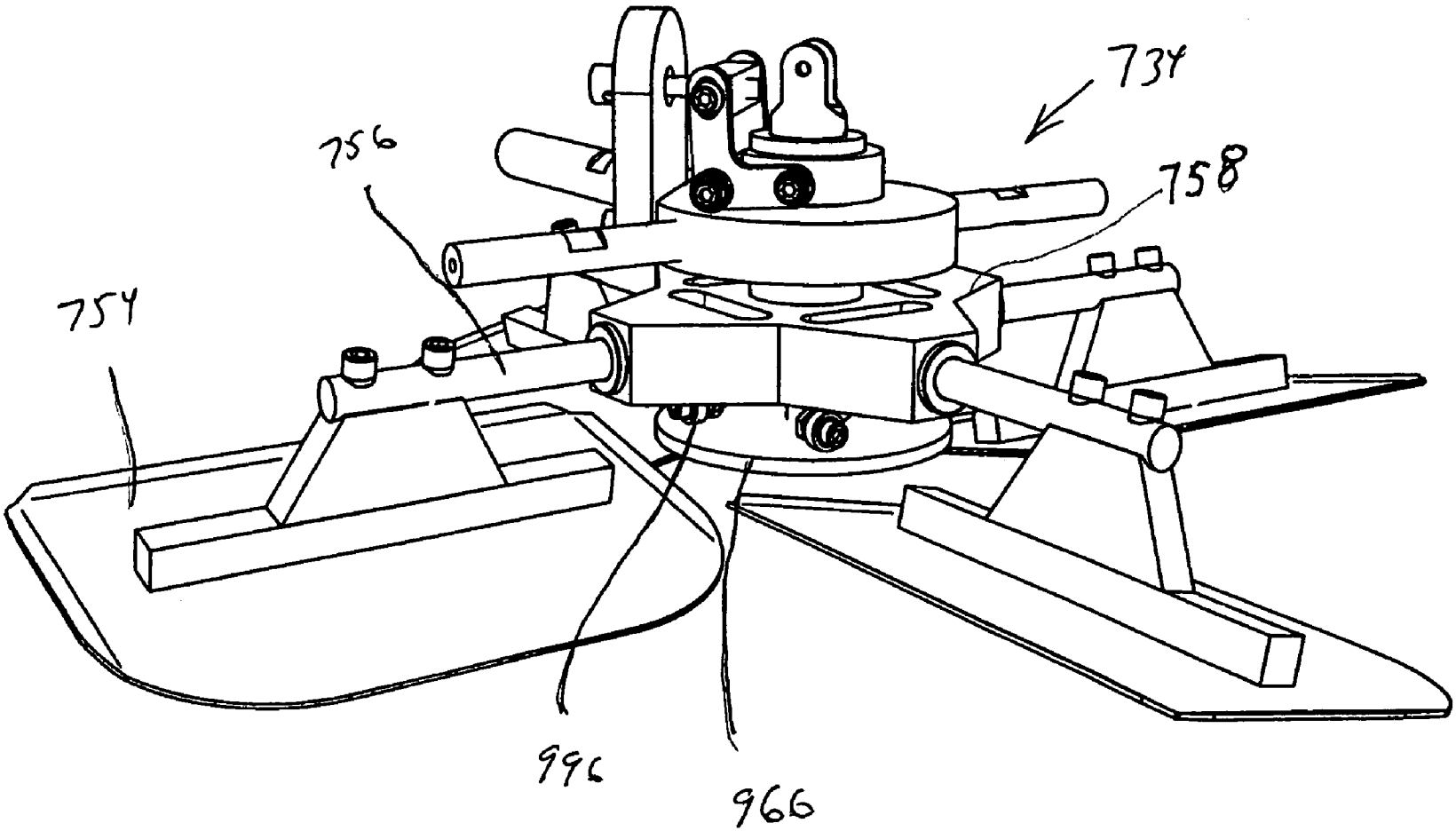
F.G. 9C

REMOTELY-CONTROLLED CONCRETE TOOL ASSEMBLY

RELATED APPLICATIONS

This application is a continuation-in-part of application Ser. No. 10/211,620 filed on Aug. 2, 2002 now abandoned, and entitled "Remotely-Controlled Concrete Tool Assembly". This application also claims priority on Provisional Application Ser. No. 60/625,615 filed on Nov. 6, 2004 and entitled "Remotely-Controlled Concrete Tool Assembly". As far as is permitted, the contents of application Ser. No. 10/211,620, and Provisional Application Ser. No. 60/625,615 are incorporated herein by reference.

BACKGROUND

The use of concrete in residential and commercial construction is pervasive. Generally, a multiple step procedure is followed for the placement and finishing of these types of concrete structures to obtain the desired durability and the desired finish. For instance, forms are often used to define the location and boundaries of the structure to be placed. Once the concrete is placed within the forms, a screed can be utilized to flatten the surface of the concrete. Next, the concrete can be tamped in order to remove air pockets and ensure that the concrete is sufficiently compacted. Further, a screen can be used to urge the larger aggregate to move away from the surface of the concrete toward the interior of the structure. The concrete is then "finished" by repetitiously using a trowel to smooth the surface in order to obtain the desired texture.

The finishing process can be performed by hand or by a machine. Unfortunately, finishing concrete by hand can be time-consuming and can result in an inconsistent pressure being exerted on the concrete which can cause a somewhat uneven surface. Further, existing finishing machines are not entirely satisfactory.

SUMMARY

The present invention is directed to a concrete tool assembly used on a concrete surface. The tool assembly includes a surfacing apparatus having a frame, a first trowel assembly that is movably coupled to the frame, a second trowel assembly that is movably coupled to the frame, and a pitch mover. In one embodiment, the first trowel assembly includes a plurality of first trowels and the second trowel assembly includes a plurality of second trowels. Further, in one embodiment, the pitch mover adjusts the pitch of the first trowels and the pitch of the second trowels relative to the surface at approximately the same time.

In another embodiment, the frame defines a frame chamber and includes a fan that moves a fluid through at least a portion of the frame chamber to control the environment in the frame chamber. In this embodiment, one or more mechanical components and/or one or more electrical components are positioned in the frame chamber.

In yet another embodiment, the surfacing apparatus can also include a sensor that senses the position of the surfacing apparatus, and a controller that controls the surfacing apparatus based upon the position sensed by the sensor. With this design, in certain embodiments, the surfacing apparatus can finish a surface with little, if any supervision or control of a user.

The present invention is also directed to a method for finishing a concrete surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1A is a perspective view of a first embodiment of a concrete tool assembly including a surfacing apparatus and a remote control unit having features of the present invention;

FIG. 3A is a simplified bottom view of a portion of the surfacing apparatus including a trowel assembly;

FIG. 3B is a simplified schematic side view of the trowel assembly during movement of the surfacing apparatus in a forward direction;

FIG. 3C is a simplified schematic side view of the trowel assembly during movement of the surfacing apparatus in a backward direction;

FIG. 3D is a simplified schematic side view of the trowel assembly during rotation of the surfacing apparatus in a clockwise direction;

FIG. 3E is a simplified schematic side view of the trowel assembly during rotation of the surfacing apparatus in a counterclockwise direction;

FIGS. 3F and 3G are alternate simplified schematic side views of the trowel assembly during movement of the surfacing apparatus sideways;

FIG. 7C is a perspective view of a portion of the surfacing apparatus of FIG. 7A;

FIG. 8 is a perspective view of a shroud from FIG. 7A;

FIG. 9C is a perspective view of a portion of the concrete tool assembly of FIG. 7A with the trowels rotated.

DESCRIPTION

Figure 1B:
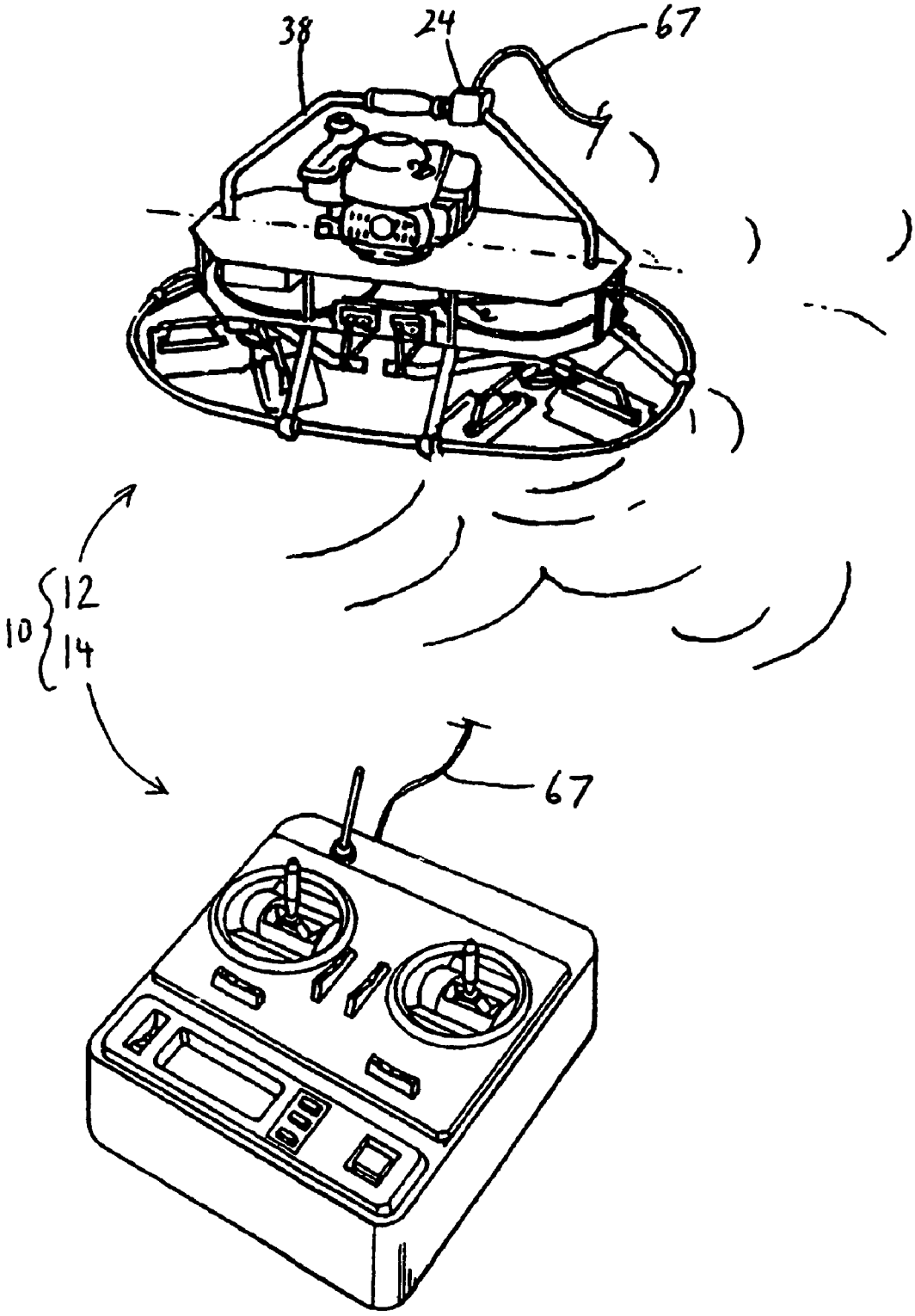
FIG. 1B is a perspective view of a second embodiment of a concrete tool assembly including a surfacing apparatus and a remote control unit having features of the present invention.

FIG. 1A illustrates a concrete tool assembly 10 having features of the present invention, including a surfacing apparatus 12 and a remote control unit 14. As provided herein, movement and/or one or more functions of the surfacing apparatus 12 is controlled by the remote control unit 14. With this design, a user of the concrete tool assembly 10 can control various concrete finishing tasks despite the user having no physical contact with the surfacing apparatus 12. The present invention allows the user to be positioned in a location remote from the surfacing apparatus 12 and the concrete surface 16 to be treated. The concrete tool assembly 10 can be used at various stages during the concrete placement and/or finishing process. The concrete tool assembly 10 provided herein can be particularly useful during the finishing stage of concrete placement, also known as concrete finishing.

The surfacing apparatus 12 receives signals from the remote control unit 14 which guide movement of the surfacing apparatus 12 over the concrete surface 16. The design of the surfacing apparatus 12 can be varied to suit the design requirements of the remote control unit 14 and the surface 16 to be finished. In the embodiment illustrated in FIG. 1A, the surfacing apparatus 12 includes a frame 18, a drive motor 20, a signal receiver 22, a controller 24, a gear assembly 26, one or more actuator assemblies 28, one or more feedback devices 30, a power source 32, one or more trowel assemblies including a first trowel assembly 34A and a second trowel assembly 34B, a trowel guard 36 and a handle 38.

The frame 18 supports the various components of the surfacing apparatus 12. The design of the frame 18 can vary depending upon the size and positioning of the components included in the surfacing apparatus 12. In this embodiment, the frame 18 includes a top plate 40, a spaced apart bottom plate 42 and a plurality of plate supports 44 that secure the top plate 40 to the bottom plate 42. The materials used to form the plates 40, 42 can vary. For example, the plates 40, 40 can be formed from rigid materials such as metal alloys, plastics or ceramics. However, any suitably rigid material having the desired strength can be used. The plate supports 44 can also be formed from similar materials, and can be welded to the plates 40, 42, or secured to the plates 40, 42 with fasteners (not shown) such as nuts and bolts, or screws, as non-exclusive examples. The frame 18 also has a longitudinal axis 46.

The drive motor 20 drives rotation of the gear assembly 26. Various types of engines can be used as the drive motor 20, provided the drive motor 20 has sufficient horsepower to adequately drive the gear assembly 26. For example, the drive motor 20 can be gas-powered or electric. In one embodiment, the drive motor 20 can be a Honda GXV 50, four-stroke, 49 cubic centimeter (cc) displacement, gas-powered motor. In alternate embodiments, the drive motor 20 can be a two-stroke engine, can have a displacement that is greater or less than 49 cc, or can be electrically or battery powered.

In FIG. 1A, the drive motor 20 further includes a rotation adjuster 48. In one embodiment, the rotation adjuster 48 is a throttle assembly that can adjust the power output of the drive motor 20. The specific rotation adjuster 48 used in the drive motor 20 can vary. For example, the rotation adjuster 48 can be a Hitec HS-300 standard throttle and an actuator for the throttle. Alternately, the rotation adjuster 48 can be any other suitable device that adjusts the power output and/or the rotational speed of the drive motor 20.

The signal receiver 22 receives signals from the remote control unit 14. The type of signal receiver 22 included in the surfacing apparatus 12 can vary. In the embodiment illustrated in FIG. 1A, the signal receiver 22 is an antenna that receives radio waves from the remote control unit 14. Specifically, the signal receiver 22 shown in FIG. 1A can be a Hitec RCD 3500 receiver. In alternate embodiments, the signal receiver 22 can be capable of receiving other frequencies of waves, or can receive electrical signals from the remote control unit 14.

The controller 24 processes the signals that are received by the signal receiver 22 and directs current to the rotation adjuster 48, the actuator assemblies 28, the feedback devices 30 and/or the trowel assemblies 34A, 34B. The design of the controller 24 can be varied to suit the design characteristics of the remote control unit 14 and the surfacing apparatus 12. For example, in one embodiment, the controller 24 is a Hitec RCD 3500 dual conversion unit with an ultra narrow band. However, any suitable controller 24 can be used with the present invention. The controller 24 can control the distribution of electrical or other signals to the actuator assemblies 28 and other components of the surfacing apparatus 12. Although one controller 24 is illustrated in the embodiment shown in FIG. 1A, the surfacing apparatus 12 can include more than one controller 24. Moreover, the controller 24 can be wireless, or can utilize electrical wires between the controller 24 and the components being controlled by the controller 24.

The gear assembly 26 is coupled to and is driven by the drive motor 20. The design and positioning of the gear assembly 26 can vary widely. As explained in greater detail below, the gear assembly 26 includes a plurality of gears having varying sizes and numbers of gear teeth. Rotation of the gears results in rotation of the trowel assemblies 34A, 34B over the surface 16 of the concrete. By selecting various sized gears for use in the gear assembly 26, an appropriate gear ratio between the drive motor 20 and the trowel assemblies 34A, 34B can be attained to increase the efficiency of the concrete tool assembly 10. In the embodiment illustrated in FIG. 1A, the gear ratio is 40:1. In alternate embodiments, for example, the gear ratio can be 25:1, 30:1, 35:1, 45:1 or 50:1.

Each actuator assembly 28 interacts with one or more of the trowel assemblies 34A, 34B to alter the angle of each trowel assembly 34A, 34B relative to the concrete surface 16. The design and the number of actuator assemblies 28 can vary. In FIG. 1A, the surfacing apparatus 12 includes two actuator assemblies 28. Alternately, greater or fewer than two actuator assemblies 28 can be used. Each actuator assembly 28 includes one or more actuators 50 and one or more arm assemblies 52. In the embodiment illustrated in FIG. 1A, each actuator assembly 28 includes two actuators 50 (only one actuator 50 is shown in FIG. 1A for each actuator assembly 28). The actuator 50 receives one or more electrical signals from the controller 24 which can cause the actuator 50 to move a portion of the arm assembly 52. In one embodiment, each actuator 50 is a servomotor such as a Hitec HS-300BB Standard Bearing Servo, as a non-exclusive example. In another embodiment, each actuator 50 can be another type of mover or motor.

Each arm assembly 52 is coupled to one of the trowel assemblies 34A, 34B. With this design, movement of the actuators 50 can cause movement of a corresponding trowel assembly 34A, 34B relative to the concrete surface 16. As provided herein, by altering the angle of the trowel assembly 34A, 34B relative to the concrete surface 16 during operation of the concrete tool assembly 10, movement of the surfacing apparatus 12 over the concrete surface 16 can be accurately controlled. In another embodiment, the surfacing apparatus 12 can include additional actuator assemblies (not shown) to provide refined movement of the trowel assemblies 34A, 34B relative to the concrete surface 16, thereby allowing a user to more accurately control movement of the surfacing apparatus 12 over the concrete surface 16, as described in greater detail below.

The feedback device(s) 30 can monitor movement of one of the trowel assemblies 34A, 34B relative to the other trowel assembly 34B, 34A to achieve the desired result from the standpoint of the user. Stated another way, when the user inputs a specific command into the remote control unit 14, the feedback device(s) 30 can monitor and/or sense the movement of the surfacing apparatus 12 to determine if such movement is consistent with the desired result as input by the user. The feedback device 30 can then provide feedback information to the controller 24. The controller 24 can, in turn, adjust the movement and/or position of one of the trowel assemblies 34A, 34B relative to the other trowel assembly 34B, 34A accordingly so that the resultant movement of the surfacing apparatus 12 is consistent with the command specified by the user. With this design, operation of the concrete tool assembly 10 is more stable and requires less adjustment and/or micromanagement of the remote control unit 14 by the user. The specific feedback device 30 can be varied depending upon the design requirements of the surfacing apparatus 12. For example, each feedback device 30 can include a gyro such as a Cirrus MPG-10 Micro Piezo Gyro.

The power source 32 can provide power to any electrical components of the surfacing apparatus 12, such as the controller 24, the actuator assemblies 28 and the feedback devices 30, as examples. The power source 32 can be a battery that is secured to the frame 18 of the surfacing apparatus 12. The voltage of the battery can vary, provided sufficient voltage is maintained to provide power to all of the necessary components. For example, the battery can be a Panasonic Gel-cell 6 volt battery. In an alternate embodiment, the drive motor 20 can include a generator (not shown in FIG. 1A) that can provide power to the controller 24, the actuator assemblies 28, the feedback devices 30 and any other component that requires a power source 32. In this alternate embodiment, the battery can be omitted.

The trowel assemblies 34A, 34B rotate over the concrete surface 16, resulting in the desired finish in the concrete surface 16. The design of each trowel assembly 34A, 34B can be varied. In the embodiment illustrated in FIG. 1A, the surfacing apparatus 12 includes two trowel assemblies 34A, 34B. In alternate embodiments, the surfacing apparatus 12 can include greater or fewer than two trowel assemblies 34A, 34B. Each trowel assembly 34A, 34B includes one or more trowels 54, each being secured to a trowel arm 56. Further, each trowel assembly 34A, 34B includes a trowel hub 58 that rotatably couples the trowels 54 to the gear assembly 26. Thus, the gear assembly 26 rotates the trowel hub 58, which moves the trowels 54 over the concrete surface 16. The entire trowel assembly 34A, 34B can be angled relative to the concrete surface 16, as described previously.

Additionally, the pitch of each of the trowels 54 relative to the surface 16 and to the trowel hub 58 can be adjusted, either individually or collectively in certain embodiments, as provided below. By adjusting the pitch of the trowels 54, the number of pounds of force per square inch experienced by the concrete surface 16 can be increased or decreased. With this design, the concrete tool assembly 10 can be used with concrete at various stages in the curing process, and with different mixtures of concrete. For example, concrete that is drier may require a greater trowel pitch than concrete that has a higher moisture content. As a further example, the trowel pitch can be decreased, e.g. flattened relative to the concrete surface 16, for concrete having a higher than normal water to cement ratio, thereby increasing finishing quality and efficiency.

Each trowel 54 can be formed from various metal alloys or other sufficiently durable and rigid materials. For example, the trowels 54 can be formed from stainless steel or other sheet metals. Further, the size and shape of each trowel 54 can vary depending upon the size of the overall surfacing apparatus 12, the number of trowels 54, the number of trowel assemblies 34A, 34B, etc. In one embodiment, each trowel 54 is substantially rectangular, and can have a trowel width of approximately five inches and a trowel length of approximately seven inches. In alternate embodiments, the trowel width can be greater or smaller than five inches, and the trowel length can be greater or smaller than seven inches. In still an alternate embodiment, the trowel 54 can be disk-shaped, doughnut-shaped, triangular, elliptical, or can have any other suitable geometry. Moreover, each trowel 54 includes a top surface 57 that does not contact the concrete surface 16, and a contact surface 59 (illustrated in FIG. 2) that does contact the concrete surface 16.

The trowel guard 36 inhibits contact between the trowel assemblies 34A, 34B and structures other than the concrete surface 16. The size, shape and positioning of the trowel guard 36 can be varied depending upon the design requirements of the surfacing apparatus 12. During operation, if the surfacing apparatus 12 approaches a concrete form, the side of a building, reinforcing steel, or any other potentially damaging structure, the trowel guard 36 maintains a minimum spacing between the trowel assembly 34A, 34B and such structure. With this design, the likelihood of damage to the surfacing apparatus 12 and/or the other structures is decreased. Further, the trowel guard 36 reduces the possibility of injury to the user or others by decreasing physical access to the rotating trowel assemblies 34A, 34B during operation.

The handle 38 is used to lift and/or transport the surfacing apparatus 12 during non-operation. The handle 38 is secured to the frame 18, and can include a resilient pad 60 for ease in gripping the handle 38.

Further, because the surfacing apparatus 12 is not ridden by the user, the surfacing apparatus 12 can be constructed to be relatively lightweight. The weight of the surfacing apparatus 12 can vary depending upon the size and materials of the surfacing apparatus 12 and the trowel assemblies 34A, 34B. In one embodiment, the surfacing apparatus 12 is approximately forty inches tip to tip and weighs less than approximately 80 lbs. In an alternate embodiment, the surfacing apparatus 12 is approximately fifty-two inches tip to tip and weighs within the range of between approximately 120-160 lbs. However, in alternative embodiments, the surfacing apparatus 12 can have a weight that is greater or less than this range. With these relatively low weights, the user can more easily transport the surfacing apparatus 12 using the handle 38. Moreover, because of the relatively lightweight construction of the surface apparatus 12, the present invention can be used with concrete which may be less hardened than concrete that must support a "ride on" concrete tool assembly.

The remote control unit 14 sends signals to the signal receiver 22 for controlling movement of the surfacing apparatus 12. The design of the remote control unit 14 can vary widely. In the embodiment illustrated in FIG. 1A, the remote control unit 14 is a radio controlled device that sends radio signals to the signal receiver 22. Stated another way, the remote control unit 14 is mechanically and electrically isolated from the surfacing apparatus 12. For example, the remote control unit 14 illustrated in FIG. 1A is a Hitec Flash 4 System X, battery operated unit. The remote control unit 14 can have multiple channels, and can include a signal transmitter 62, a throttle control 64 and a directional control 66. The signal transmitter 62 sends the radio or other signal from the remote control unit 14 to the surfacing apparatus 12. The throttle control 64 controls the rotation adjuster 48 of the drive motor 20 to increase or decrease the rotation of the trowel assemblies 34A, 34B. In one embodiment, the throttle control 64 is not spring-loaded. This allows the user to set and maintain the throttle control 64 at a desired position, without having to maintain hold the throttle control 64. Alternatively, the user must actively maintain control of the throttle control 64.

The directional control 66 controls the angle of the trowel assemblies 34A, 34B relative to the concrete surface 16 to influence the position and movement of the surfacing apparatus 12 over the concrete surface 16. The directional control 66 in this embodiment is spring-loaded. Stated another way, if the directional control 66 were released by the user, e.g. dropped, the directional control 66 would return to a default position. In one embodiment, in the default position, the directional control 66 inhibits any forward, backward or rotational movement of the surfacing apparatus 12 relative to the concrete surface 16.

Further, the remote control unit 14 can include additional controls and/or readout information. For instance, the remote control unit 14 can include internal mixing features (not shown). The mixing features allow the controller 50 to independently operate multiple components simultaneously. For example, a single control stick can be used to control fore, aft, right and left movements of the tool assembly 10. Stated another way, a single control stick can be used to alter the angle of both trowel assemblies 34A, 34B. Further, the remote control unit 14 can include a display, e.g. various LED readouts, that provide information regarding operation of the surfacing apparatus 12 to the user. However, in one embodiment, the remote control unit 14 controls the surfacing apparatus 12 using the throttle control 64 and the directional control 66.

FIG. 1B illustrates an alternate embodiment of the concrete tool assembly 10. In this embodiment, the remote control unit 14 is in electrical communication with the surfacing apparatus 12 and can send electrical signals to the controller 24 over a wiring assembly 67 to control movement of the surfacing apparatus 12. Stated another way, the remote control unit 14 is mechanically isolated from the surfacing apparatus 12. The controller 24 can be positioned in any convenient location on the surfacing apparatus 12. In FIG. 1B, the controller is positioned on the handle 38. In yet another alternate embodiment, the remote control unit 14 can operate by sending any type remote signal to the controller 24, provided the controller 24 can receive such remote signals from the remote control unit 14, and can carry out the desired commands input into the remote control unit 14 by the user.

Figure 1C:
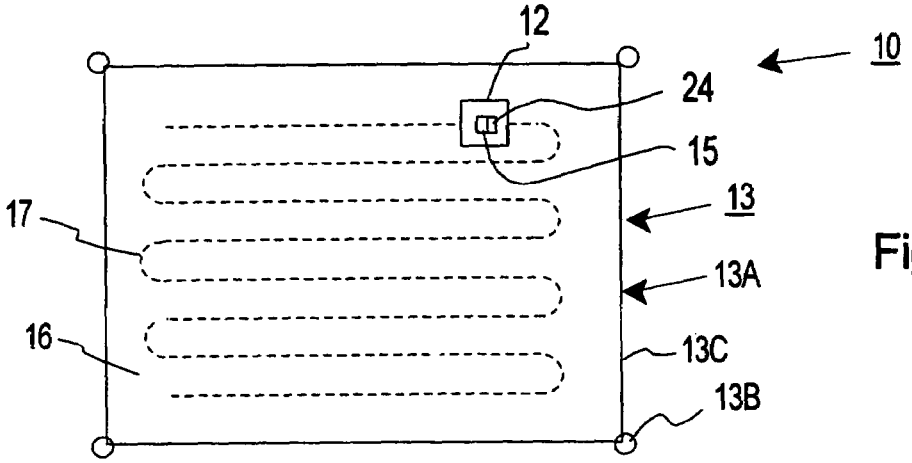
FIG. 1C is a simplified top illustration of another embodiment of a concrete tool assembly having features of the present invention.

FIG. 1C illustrates a simplified top view of another embodiment of the concrete tool assembly 10. In this embodiment, the concrete tool assembly 10 can include the surfacing apparatus 12, and a marker system 13 that is positioned by the user. The marker system 13 can be positioned near the perimeter of the surface 16 being finished, or in another suitable location. In FIG. 1C, the marker system 13 defines a substantially rectangular boundary 13A around a substantially rectangular surface 16 that is being finished. However, the shape of the boundary 13A defined by the marker system 13 can be varied depending upon the shape of the surface 16 to be finished.

Further, in one embodiment, the surfacing apparatus 12 includes a sensor 15 that senses a distance and/or relative positioning between the sensor 15 and the marker system 13. The sensor 15 is in electrical communication with the controller 24. The design and type of marker system 13 can vary depending upon the requirements of the sensor and the rest of the surfacing apparatus 12. In the embodiment illustrated in FIG. 1C, the marker system 13 includes a plurality of marker poles 13B and a plurality of marker lines 13C. In this embodiment, one marker pole 13B is positioned at each corner and one marker line 13C extends between two marker poles 13B. Alternatively, for example, the marker system 13 can be designed with only the marker poles 13B or marker lines 13C.

In one embodiment, the marker poles 13B and the marker lines 13C can be a wire formed from a material that can be sensed by the sensor 15. With this design, the marker system 13 can be positioned by the user in a manner that is consistent the surface 16 being finished and with the design requirements of the sensor 15. In an alternate embodiment, the marker system 13 can include one or more laser sources that generate one or more laser beams that define the desired boundary 13A. However, any suitable marker system 13 can be used with the present invention, provided the surfacing apparatus 12 can dynamically sense the relative position of the marker system 13.

In the embodiment illustrated in FIG. 1C, movement of the surfacing apparatus 12 is controlled by communication between the marker system 13 and the sensor 15. For example, the sensor 15 can continually monitor a distance between the surfacing apparatus 12 and the marker system 13, and can communicate this information to the controller 24. Accordingly, the controller 24 can control movement of the trowel assemblies 34A, 34B (illustrated in FIG. 1A) so that the surfacing apparatus 12 moves in a manner that allows the entire surface 16 to be processed.

For instance, the controller 24 can control movement of the surfacing apparatus 12 in a back and forth manner (as indicated by dotted line 17) based on the distance between the sensor 15 and the marker system 13. Alternately, the controller 24 can control movement of the surfacing apparatus 12 in other directions, such as increasingly smaller perimeters of the surface 16, increasingly larger perimeters of the surface 16, circular movements, etc. Still alternately, the sensor 15, the controller 24 and the marker system 13 can be set up and programmed so that only a portion of the concrete surface 16 is surfaced by the surfacing apparatus 12, as desired by the user.

Figure 1D:
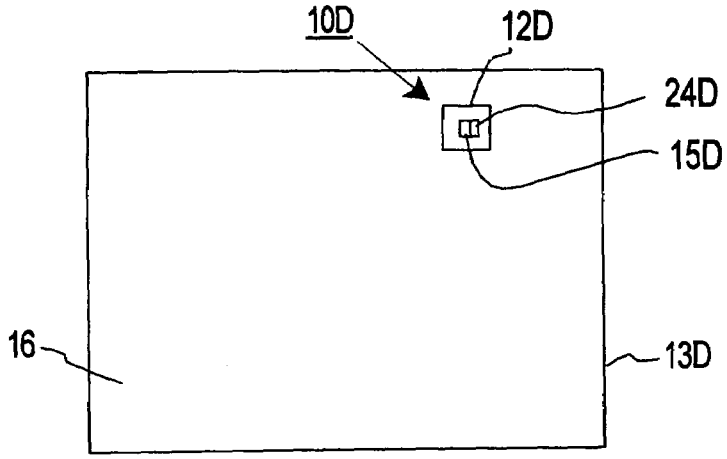
FIG. 1D is a simplified top illustration of yet another embodiment of a concrete tool assembly having features of the present invention.

FIG. 1D illustrates a simplified top view of yet another embodiment of the concrete tool assembly 10D. In this embodiment, the surfacing apparatus 12D again includes a sensor 15D that is in electrical communication with the controller 24D of the surfacing apparatus 12D. For example, the sensor 15D can include a global positioning system that constantly monitors and determines the global position of the surfacing apparatus 12D in real time relative to one or more satellites. In one embodiment, the global position of one or more locations of the desired boundary 13D of the surface 16 can be transferred and/or inputted into the controller 24D. With this information, the controller 24D can control movement of the surfacing apparatus 12D to finish the surface 16.

Figure 1E:
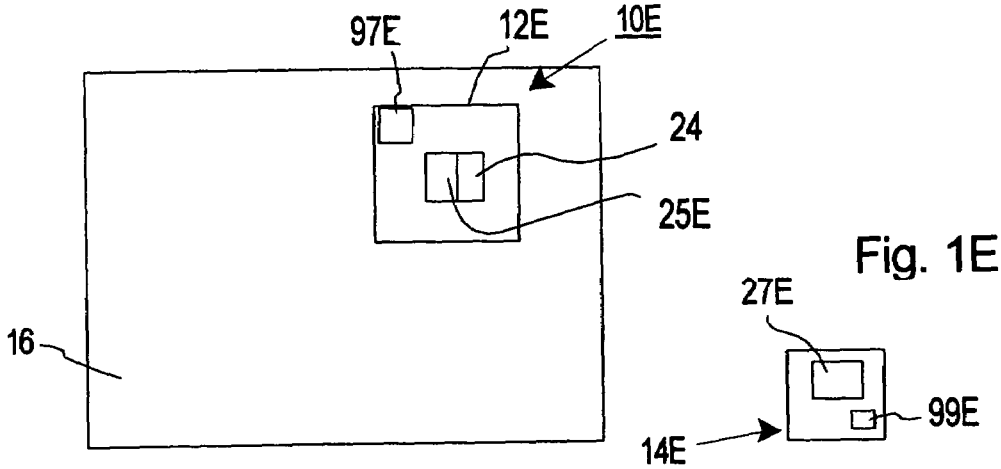
FIG. 1E is a simplified top illustration of still another embodiment of a concrete tool assembly having features of the present invention.

FIG. 1E illustrates a simplified top view of yet another embodiment of the concrete tool assembly 10E. In this embodiment, the surfacing apparatus 12E includes a video system 25E, e.g. one or more video cameras, that provide a streaming video to a remotely located video display 27E. In one embodiment, the video display 27E can be integrated into the remote control unit 14E. Alternatively, the video display 27E can be a separate display. With this design, the surface apparatus 12D can be operated in remote locations that are not visible to the operator.

Additionally, or alternatively, the surfacing apparatus 12E can include a moisture sensor 97E that constantly or intermittently monitors the moisture content of the surface 16E being processed near the surfacing apparatus 12E. In one non-exclusive embodiment, for example, the moisture sensor 97E can be capacitance type sensor that measures the moisture content of the surface 16E. The moisture sensor 97E, for example, can be attached to one of the trowels (not shown) or another location on the surfacing apparatus.

In one embodiment, information from the moisture sensor 97E regarding the moisture content can be displayed on a moisture display 99E on the remote control unit 14E. With this information, the operator can control the movement of the surfacing apparatus 12E accordingly. For example, the operator can remotely adjust the pitch of the trowels to correspond to the moisture of the surface 16. Alternatively, the operator can control the movement of the surfacing apparatus 12E to finish the areas of the surface 16 that are the least moist first.

It should be noted that the concrete finishing assembly 10E with the moisture sensor 97E could be designed to operate with or without the remote control unit 14E. For example, the controller 24E can receive information from the moisture sensor 97E and can control the movement of the surfacing apparatus 12E accordingly. For example, the controller 24E can adjust the pitch of the trowels to correspond to the moisture of the surface. Alternatively, the controller 24E can control the movement of the surfacing apparatus 12E to finish the areas of the surface that are the least moist first.

In either design, if a specific amount of moisture is detected by the moisture sensor 97E, the surface apparatus 12E can be stopped by the user or automatically by the controller 24E until the moisture level decreases to a suitable level.

Figure 2:
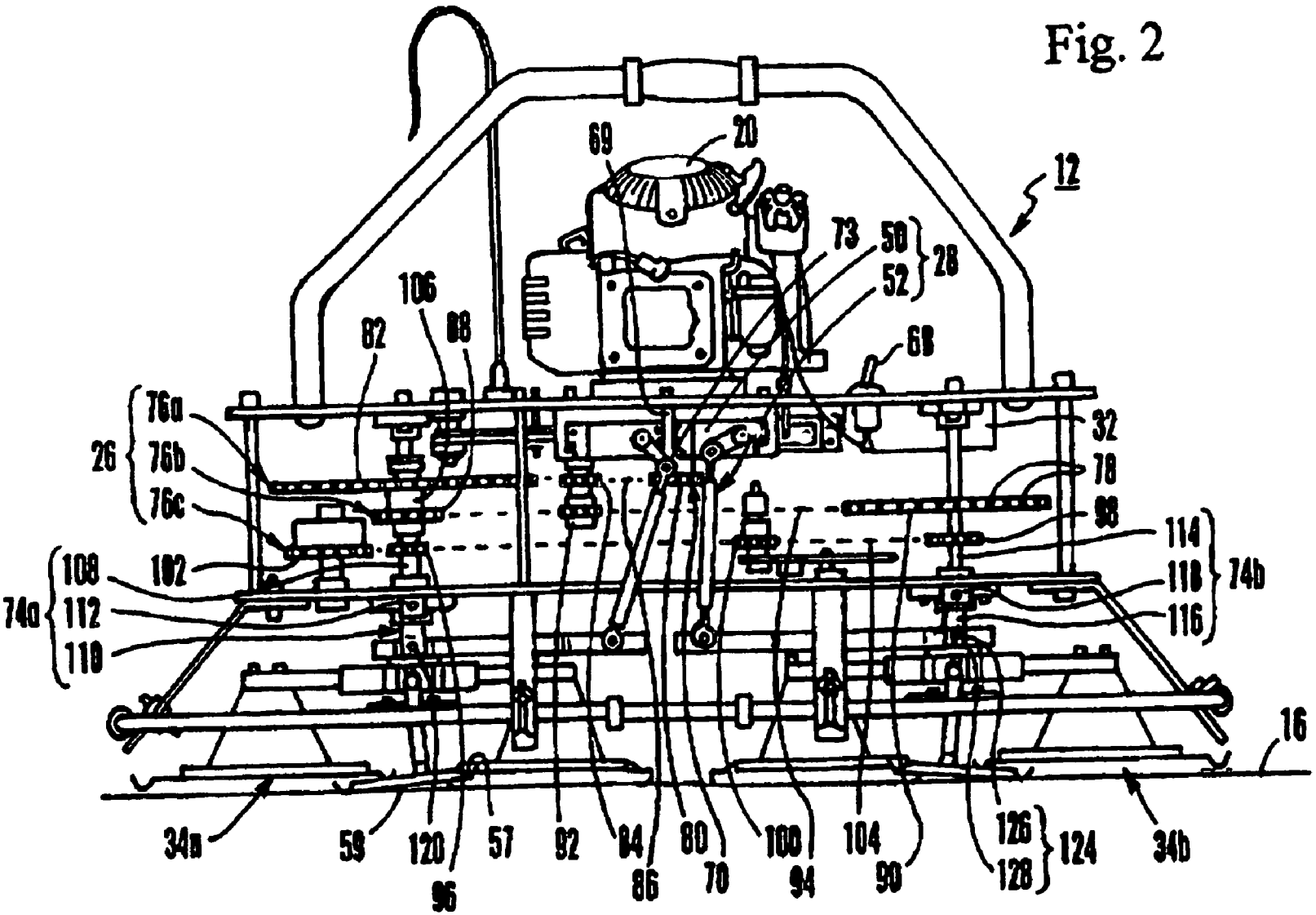
FIG. 2 is a side view of an embodiment of the surfacing apparatus.

FIG. 2 is a side view of the surfacing apparatus 12 of FIG. 1A. FIG. 2 illustrates that the surfacing apparatus 12 also includes a power switch 68 that allows the user to manually shut off the electrical power to or from various components of the surfacing apparatus 12, such as the drive motor 20 and the power source 32.

The drive motor 20 illustrated in FIG. 2 includes a drive shaft 69 that rotates when the drive motor 20 is powered up. The surfacing apparatus 12 illustrated in FIG. 2 includes a clutch 70 that releasably engages the drive shaft 69 to the gear assembly 26. In one embodiment, the clutch 70 is a centrifugal clutch that engages the gear assembly 26 upon a drive shaft 69 of the drive motor 20 reaching a predetermined number of revolutions per minute. In an alternate embodiment (not shown), the clutch 70 includes a gear that interacts with the gear assembly 26 upon engagement of the clutch 70. Any centrifugal clutch 70 of the appropriate size can be used in the surfacing apparatus 12. In another embodiment, the clutch 70 can be an electrical or hydraulic clutch that can be controlled by the remote control unit 14 (illustrated in FIG. 1). The centrifugal clutch 70 allows the drive motor 20 of the surfacing apparatus 12 to idle without movement of the surfacing apparatus 12 over the concrete surface 16. When the user desires to commence surfacing of the concrete surface 16, the throttle control 64 (illustrated in FIG. 1) of the remote control unit 14 can be used to increase the revolutions per minute of the drive motor 20. Consequently, the clutch 70 engages and movement of the surfacing apparatus 12 over the concrete surface 16 occurs.

As illustrated in FIG. 2, the clutch 70 includes a clutch output shaft 73 that rotates upon engagement between the drive shaft 69 and the clutch 70. The clutch output shaft 73 is secured to the gear assembly 26 so that rotation of the clutch output shaft 73 causes rotation of a portion of the gear assembly 26.

The gear assembly 26 includes a plurality of gear layers, a first gear assembly shaft 74A and a second gear assembly shaft 74B that cooperate to move the trowel assemblies 34A, 34B, and thus the surfacing apparatus 12, along the concrete surface 16. In FIG. 2, the gear assembly 26 has three gear layers that include an upper gear layer 76A, an intermediate gear layer 76B and a lower gear layer 76C, moving from top to bottom along the surfacing apparatus 12. However, in alternate embodiments, the number of gear layers can be greater or less than three. Further, any of the gear layers 76A-76C can be the upper gear layer 76A, the intermediate gear layer 76B or the lower gear layer 76C. Moreover, each gear layer includes one or more gears that each has a plurality of teeth 78. The specific number of teeth on each gear can be varied to ultimately control the angular velocity of the trowel assemblies 34A, 34B.

In FIG. 2, the upper gear layer 76A includes a drive gear 80, an upper first assembly gear 82, an upper tensioner 84 and an upper gear chain 86 (illustrated as a dashed line). The intermediate gear layer 76B includes an intermediate first assembly gear 88, an intermediate second assembly gear 90, an intermediate tensioner 92 and an intermediate gear chain 94 (illustrated as a dashed line). The lower gear layer 76C includes a lower first assembly gear 96, a lower second assembly gear 98, a lower tensioner 100, a lower directional gear 102 and a lower gear chain 104 (illustrated as a dashed line).

The drive gear 80 is secured to the clutch output shaft 73 of the clutch 70. The upper gear chain 86 engagingly connects the drive gear 80 to the upper first assembly gear 82 so that rotation of the drive gear 80 drives rotation of the upper first assembly gear 82. In one embodiment, because rotation of the drive gear 80 can exceed a rate of approximately 4,500 revolutions per minute, which is greater than the desired rotation rate of the trowel assemblies 34A, 34B, the gear layers 76A-76C cooperate to gear down this relatively high rotation rate. As illustrated in FIG. 2, the drive gear 80 includes a fewer number of teeth 78 than the upper first assembly gear 82. Thus, rotation of the upper first assembly gear 82 is at a slower rate than rotation of the drive gear 80. As a result, the ultimate rotation of the trowel assemblies 34A, 34B can be controlled by the specific gear ratios provided. In one embodiment, the trowel assemblies 34A, 34B can be approximately 120 revolutions per minute.

In alternate embodiments, the trowel assemblies can rotate at greater than or less than 120 revolutions per minute.

The number of teeth 78 of the drive gear 80 can vary depending upon the design requirements of the surfacing apparatus 12 and the desired gear ratio between the drive gear 80 and the upper first assembly gear 82. For example, the drive gear 80 can include approximately 11 teeth, while the upper first assembly gear 82 can include approximately 72 teeth. The upper tensioner 84 maintains an appropriate tension in the upper gear chain 86 to inhibit disengagement of the upper gear chain 86 from the drive gear 80 and the upper first assembly gear 82. The upper first assembly gear 82 is secured to a rotating first assembly bearing 106 that rotates around the first gear assembly shaft 74A.

The intermediate first assembly gear 88 is also secured to the first bearing assembly 106. In this embodiment, the intermediate first assembly gear 88 has fewer teeth 78 than the upper first assembly gear 82. For example, the intermediate first assembly gear 88 can have approximately 15 teeth. The intermediate gear chain 94 engagingly connects the intermediate first assembly gear 88 to the intermediate second assembly gear 90 so that rotation of the intermediate first assembly gear 88 results in rotation of the intermediate second assembly gear 90. As illustrated in FIG. 2, the intermediate first assembly gear 88 includes a fewer number of teeth 78 than the intermediate second assembly gear 90, which can have approximately 72 teeth, as a non-exclusive example. Thus, rotation of the first bearing assembly 106 is at a faster rate than rotation of the intermediate second assembly gear 90. The intermediate second assembly gear 90 is secured to the second gear assembly shaft 74B such that rotation of the intermediate second assembly gear 90 causes rotation of the second gear assembly shaft 74B. The intermediate tensioner 92 maintains an appropriate tension in the intermediate gear chain 94 to inhibit disengagement of the intermediate gear chain 94 from the intermediate first assembly gear 88 and the intermediate second assembly gear 90.

The lower first assembly gear 96 is secured to the first gear assembly shaft 74A. The lower second assembly gear 98 is secured to the second gear assembly shaft 74B. Thus, rotation of the second gear assembly shaft 74B results in rotation of the lower second assembly gear 98. The lower gear chain 104 engagingly connects the lower second assembly gear 98 to the lower first assembly gear 96 so that rotation of the lower second assembly gear 98 results in rotation of the lower first assembly gear 96. However, in this embodiment, the lower gear chain 104 engagingly passes along the lower first assembly gear 96 and proceeds around the lower directional gear 102. As a consequence, rotation of the lower second assembly gear 98 in a first direction, e.g. clockwise, results in rotation of the lower first assembly gear 96 in a second direction, e.g. counterclockwise. Therefore, in this embodiment, the first gear assembly shaft 74A and the second gear assembly shaft 74B rotate in opposite directions. Moreover, a lower tensioner 100 maintains an appropriate tension in the lower gear chain 104 to inhibit disengagement of the lower gear chain 104 from the lower first assembly gear 96, the lower second assembly gear 98 and the lower directional gear 102.

In the embodiment illustrated in FIG. 2, the first gear assembly shaft 74A includes an upper first shaft section 108, a lower first shaft section 110 and a first pivot 112 positioned between the upper first shaft section 108 and the lower first shaft section 110. The second gear assembly shaft 74B includes an upper second shaft section 114, a lower second shaft section 116 and a second pivot 118 positioned between the upper second shaft section 114 and the lower second shaft section 116. The design of the pivots 112, 118 can vary. In one embodiment, each pivot 112, 118 is a universal joint that allows pivoting of one of the lower shaft sections 110, 116 in any direction. The pivots 112, 118 can have any suitable configuration known to those skilled in the art. In one embodiment, the pivots 112, 118 can be a ball and socket joint. Alternately, the pivots 112, 118 can include other types of universal joints known to those skilled in the art.

The actuator assemblies 28 move the arm assemblies 52, which in turn cause the lower shaft sections 110, 116 to pivot in a direction that is substantially parallel to the longitudinal axis 46 (illustrated in FIG. 1) of the frame 18 relative to the upper shaft sections 108, 114. Stated another way, in the embodiment illustrated in FIG. 2, the upper shaft section 108, 114 remains substantially vertical while the lower shaft section 110, 116 can pivot at an angle relative to the upper shaft section 108, 114. In one embodiment, the lower shaft sections 110, 116 can pivot within the range of between approximately −20 degrees and 20 degrees relative to the upper shaft section 108, 114. In alternate embodiments, the lower shaft sections 110, 116 can pivot in a range that is wider or narrower than the above-stated range.

As illustrated in FIG. 2, the surfacing apparatus 12 can also include a pitch bearing assembly 124. The pitch bearing assembly 124 cooperates with the actuator assemblies 28 to angle the lower shaft section 110, 116 relative to the upper shaft section 108, 114. The pitch bearing assembly 124 includes a pitch bearing 126 and a bearing support 128. In this embodiment, the pitch bearing 126 is secured to one or more of the arm assemblies 52. The pitch bearing 126 encircles a portion of the lower shaft section 110, 116, and allows the shaft 74A, 74B to axially rotate within the pitch bearing 126. Thus, when the actuator(s) 50 move the arm assembly 52, the arm assembly 52 exerts a force on the pitch bearing 126. This force causes the pitch bearing 126 to pull or push the lower shaft section 110, 116, thereby causing the lower shaft section 110, 116 to pivot relative to the upper shaft section 108, 114 at the pivot 112, 118 of the shaft 74A, 74B. Therefore, movement of the actuator assemblies 28 causes angling of the lower shaft section 110, 116, and thus, the trowel assembly 34A, 34B, relative to the surface 16. With this design, during rotation of the trowel assemblies 34A, 34B, the user can control horizontal movement of the surfacing apparatus 12 along the surface 16 as provided in greater detail below.

The bearing support 128 supports the pitch bearing 126 along the length of the lower shaft section 110, 116. The bearing support 128 is secured to the lower shaft section 110, 116 thereby inhibiting the pitch bearing 126 from sliding down below a predetermined level of the lower shaft section 110, 116.

As provided herein, the first gear assembly shaft 74A and the second gear assembly shaft 74B can rotate in opposite directions. This design, in conjunction with the pivoting lower shaft sections 110, 116, allows the user to better control the horizontal movement of the surfacing apparatus 12 along the concrete surface 16.

FIG. 3A is a simplified bottom view of the surfacing apparatus 12 including the trowel guard 36, the first trowel assembly 34A, the second trowel assembly 34B and the frame 18. In this embodiment, the trowel guard 36 includes two curved end regions 130 and two linear regions 132. For ease of discussion, a directional arrow 134 illustrates that the first trowel assembly 34A rotates in a clockwise direction (as viewed from beneath the surfacing apparatus 12). Further, a directional arrow 136 illustrates that the second trowel assembly 34B rotates in a counterclockwise direction (as viewed from beneath the surfacing apparatus 12). It is understood that the trowel assemblies 34A, 34B can rotate in either the clockwise or the counterclockwise direction. Additionally, for ease of discussion, movement in a forward direction is indicated by arrow 138. Movement in the reverse direction is indicated by arrow 140. It is understood that either direction 138, 140 can be the forward or the reverse direction.

For purposes of the following examples, the trowel assemblies 34A, 34B each include a lateral trowel 142, a medial trowel 144 and one or more middle trowels 145. Although the trowel assemblies 34A, 34B are continually rotating, the lateral trowel 142 is whichever trowel is nearest the corresponding end region 130 of the trowel guard 36. The medial trowel 144 is whichever trowel is furthest from the end region 130 of the trowel guard 36. The middle trowels 145 are whichever trowels are between the lateral trowel 142 and the medial trowel 144.

FIGS. 3B-3G show exaggerated representations of the relative positioning of the trowel assemblies 34A, 34B during movement of the surfacing apparatus 12 over a concrete surface 16. This movement occurs during rotation of the trowel assemblies 34A, 34B in the directions shown in FIG. 3A. In order to move the surfacing apparatus 12 over the concrete surface 16, the actuator assemblies 28 (illustrated in FIG. 2) can angle the lower shaft sections 110, 116 relative to the concrete surface 16 as previously described.

FIG. 3B illustrates the relative positioning of the lower shaft sections 110, 116, and thus, the trowel assemblies 34A, 34B, relative to the concrete surface 16, during movement of the surfacing apparatus 12 in the forward direction 138 (illustrated in FIG. 3A). As illustrated in FIG. 3B, the lower shaft sections 110, 116 are angled so that a greater amount of weight of the surfacing apparatus 12 is being supported by the lateral trowels 142 than the medial trowels 144. In this position, a greater force is exerted by the surfacing apparatus 12 on the lateral trowels 142, resulting in more friction between the lateral trowels 142 and the concrete surface 16 than between the medial trowels 144 and the concrete surface 16. This frictional pattern combined with the rotational direction of each trowel assembly 34A, 34B causes the surfacing apparatus 12 to move in the forward direction 138.

FIG. 3C illustrates the relative positioning of the lower shaft sections 110, 116, and thus, the trowel assemblies 34A, 34B, relative to the concrete surface 16, during movement of the surfacing apparatus 12 in the reverse direction 140 (illustrated in FIG. 3A). As illustrated in FIG. 3C, the lower shaft sections 110, 116 are angled so that a greater amount of weight of the surfacing apparatus 12 is being supported by the medial trowels 144 than the lateral trowels 142. In this position, a greater force is exerted by the surfacing apparatus 12 on the medial trowels 144, resulting in more friction between the medial trowels 144 and the concrete surface 16 than between the lateral trowels 142 and the concrete surface 16. This frictional pattern combined with the rotational direction of each trowel assembly 34A, 34B causes the surfacing apparatus 12 to move in the reverse direction 140.

FIG. 3D illustrates the relative positioning of the lower shaft sections 110, 116, and thus, the trowel assemblies 34A, 34B, relative to the concrete surface 16, during rotation of the surfacing apparatus 12 in a clockwise direction as viewed from above. As illustrated in FIG. 3D, the lower shaft sections 110, 116 are angled so that a greater amount of weight of the surfacing apparatus 12 is being supported by the lateral trowel 142 of the first trowel assembly 34A and the medial trowel 144 of the second trowel assembly 34B than on any of the remaining trowels. In this position, the forces exerted by the surfacing apparatus 12 on the lateral trowel 142 of the first trowel assembly 34A and the medial trowel 144 of the second trowel assembly 34B result in the surfacing apparatus 12 rotating in the clockwise direction as viewed from above.

FIG. 3E illustrates the relative positioning of the lower shaft sections 110, 116, and thus, the trowel assemblies 34A, 34B, relative to the concrete surface 16, during rotation of the surfacing apparatus 12 in a counterclockwise direction as viewed from above. As illustrated in FIG. 3E, the lower shaft sections 110, 116 are angled so that a greater amount of weight of the surfacing apparatus 12 is being supported by the lateral trowel 142 of the second trowel assembly 34B and the medial trowel 144 of the first trowel assembly 34A than on any of the remaining trowels. In this position, the forces exerted by the surfacing apparatus 12 on the lateral trowel 142 of the second trowel assembly 34B and the medial trowel 144 of the first trowel assembly 34A result in the surfacing apparatus 12 rotating in the counterclockwise direction as viewed from above.

FIG. 3F illustrates an embodiment of the surfacing apparatus 12 that includes additional actuator assemblies (not shown in FIG. 3F). The additional actuators angle the lower shaft sections 110, 116 in a direction that is substantially perpendicular to the longitudinal axis 46 (illustrated in FIG. 1A) of the frame 18 (illustrated in FIG. 1A). The additional actuators allow lateral movement of the surfacing apparatus 12, e.g. substantially along the longitudinal axis 46 of the frame 18. During this movement, the lower shaft sections 110, 116 are angled so that a greater amount of weight of the surfacing apparatus 12 is being supported by one of the middle trowels 145 on one side of the first trowel assembly 34A and one of the middle trowels 145 on an opposite side of the second trowel assembly 34B than on any of the remaining trowels. In this position, the forces exerted by the surfacing apparatus 12 result in the surfacing apparatus 12 moving laterally in the direction of directional arrow 141.

FIG. 3G illustrates an embodiment of the surfacing apparatus 12 that includes additional actuator assemblies (not shown in FIG. 3G). The additional actuators angle the lower shaft sections 110, 116 in a direction that is substantially perpendicular to the longitudinal axis 46 (illustrated in FIG. 1A) of the frame 18 (illustrated in FIG. 1A). The additional actuators allow lateral movement of the surfacing apparatus 12, e.g. substantially along the longitudinal axis 46 of the frame 18. During this movement, the lower shaft sections 110, 116 are angled so that a greater amount of weight of the surfacing apparatus 12 is being supported by one of the middle trowels 145 on one side of the second trowel assembly 34B and one of the middle trowels 145 on an opposite side of the first trowel assembly 34A than on any of the remaining trowels. In this position, the forces exerted by the surfacing apparatus 12 result in the surfacing apparatus 12 moving laterally in the direction of directional arrow 143, which is substantially the opposite direction from the surfacing apparatus illustrated in FIG. 3F.

Figure 4A:
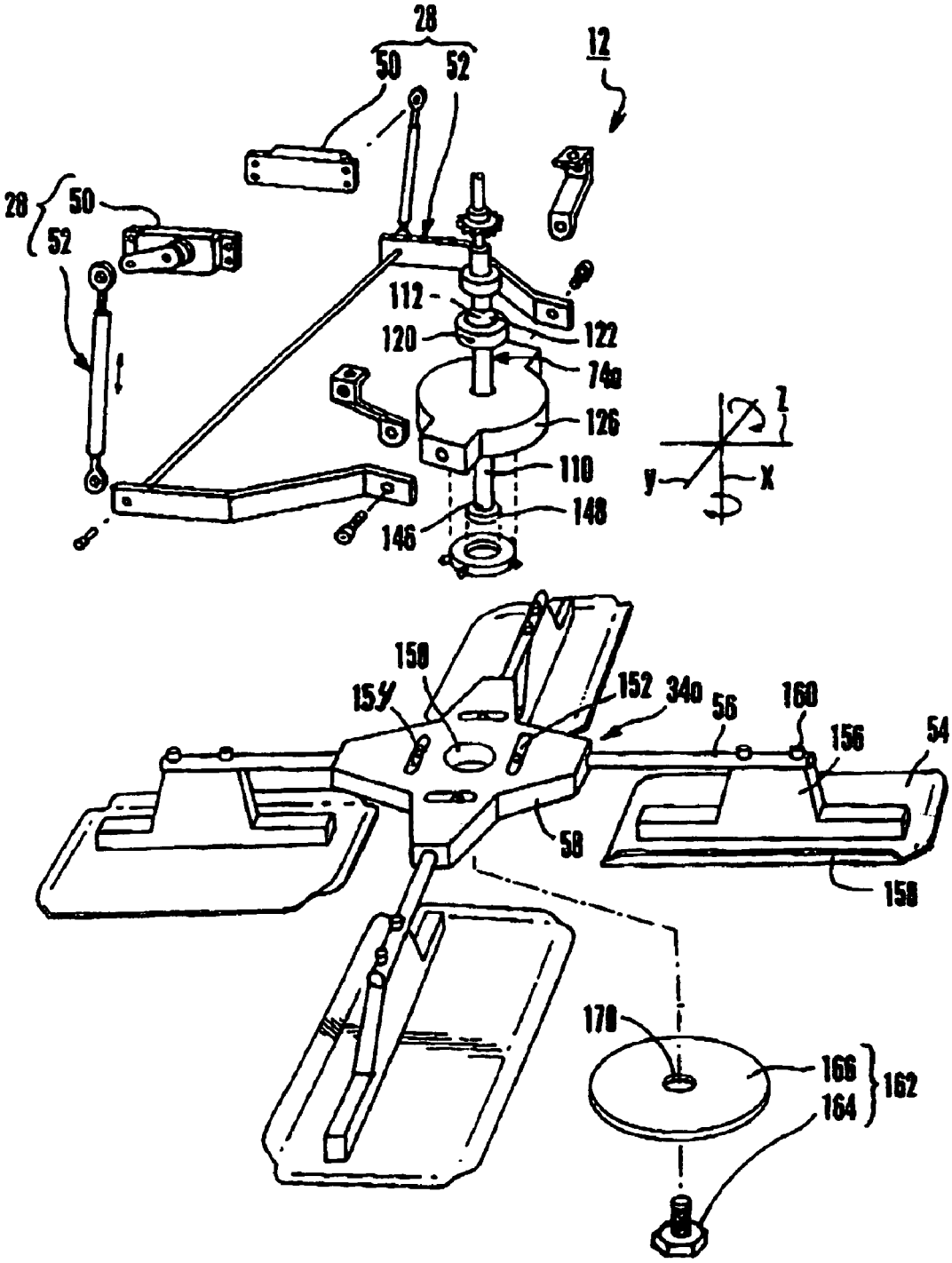
FIG. 4A is an exploded view of a portion of an embodiment of the surfacing apparatus.

FIG. 4A is an exploded view of a portion of an embodiment of the surfacing apparatus 12 including the actuator assembly 28, the first gear assembly shaft 74A and the first trowel assembly 34A. FIG. 4A illustrates an embodiment of the configuration of the actuator assembly 28. In this embodiment, the actuator assembly 28 includes two actuators 50 and two arm assemblies 52. The actuators 50 can cooperate to simultaneously move corresponding arm assemblies 52. Each arm assembly 52 is secured to the pitch bearing 126. As provided herein, movement of the actuators 50 results in movement of the pitch bearing 126, which in turn pivots the lower shaft section 110 about the first pivot 112 substantially along the Z-axis illustrated in FIG. 4A.

Moreover, as provided herein, the gear assembly 26 (illustrated in FIG. 2) causes the first gear assembly shaft 74A to rotate about the X-axis as shown in FIG. 4A. The shaft includes a distal end 146 that is secured to the trowel assembly 34A. For example, the distal end 146 can include one or more end pins 148 that interlock with the trowel hub 58 of the trowel assembly 34A to secure the first gear assembly shaft 74A to the trowel hub 58. Alternatively, other suitable means can be used to temporarily or permanently secure the distal end 146 of the first gear assembly shaft to the trowel hub 58 of the trowel assembly 34A. Thus, rotation of the first gear assembly shaft 74A results in rotation of the trowel assembly 34A.

In FIG. 4A, the trowel assembly 34A includes the trowel hub 58, four trowel arms 56 and four trowels 54. The trowel hub 58 includes a central hub aperture 150 and four hub slots 152. Each trowel arm 56 extends into and is rotatably secured to the trowel hub 58. The trowel assembly 34A also includes one or more pitch regions 154 that can each extend through a corresponding trowel arm 56. The pitch region 154 can be substantially perpendicular to the trowel arm 56, and can be positioned at or near one of the hub slots 152.

In the embodiment illustrated in FIG. 4A, each trowel 54 can have an arm attachment 156 and one or more upturned trowel edges 158. The arm attachment 156 is secured to the trowel arm 56 using one or more fasteners 160. Alternately, the trowel 54 can be secured to the trowel arm 56 in another suitable manner. The upturned trowel edges 158 inhibit the trowel 54 from inadvertently extending into the concrete surface 16, which could otherwise damage the trowel assembly 34A. Further, the trowels 54 can be formed without any excessively sharp corners or edges in order to reduce the likelihood of catching on the concrete surface or causing injury to the user during handling.

In addition, the trowel assembly 34A includes a pitch adjuster 162 that can individually or collectively adjust the pitch of the trowels 54 relative to the concrete surface 16. The pitch adjuster 162 illustrated in FIG. 4A includes a tightener 164 and an adjuster plate 166. The tightener 164 extends through a plate aperture 170 in the adjuster plate 166, and into the distal end 146 of the first gear assembly shaft 74A. The tightener 164 is threaded onto and secures the adjuster plate 166 against the pitch regions 154 of each trowel arm 56. The adjuster plate 166 can move toward the trowel hub 58 and away from the trowel hub 58 substantially along the X-axis to exert a force on each of the pitch regions 154, thereby causing the pitch regions 154 to rotate around an axis that is substantially parallel to the corresponding trowel arm 56. As a result, the trowel arm 56 axially rotates, causing the angle of the trowel 54 relative to the concrete surface 16 to change. It is recognized that although the foregoing example describes the first trowel assembly 34A, this example can equally apply to the second trowel assembly 34B, or any other trowel assembly.

Figure 4B:
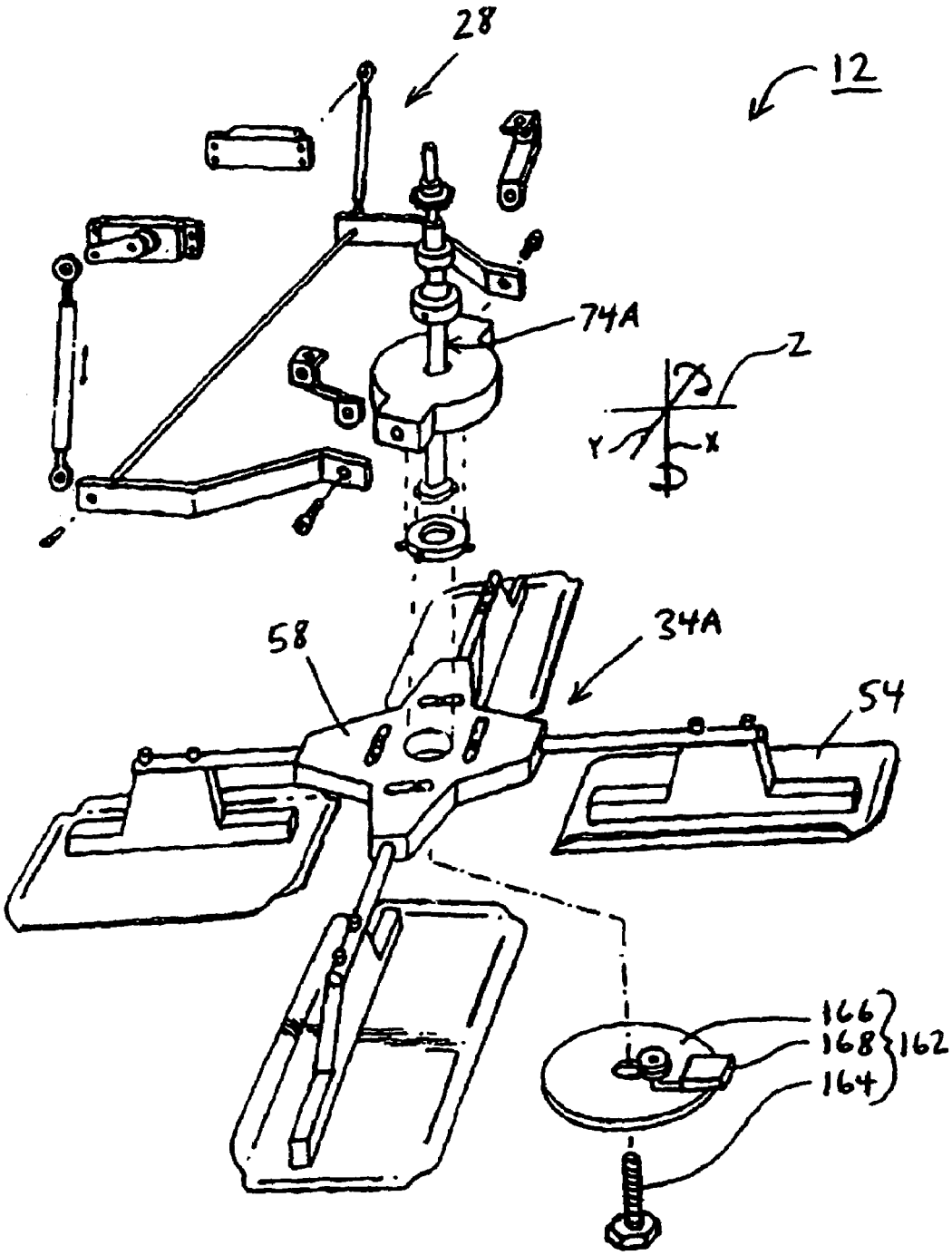
FIG. 4B is an exploded view of a portion of another embodiment of the surfacing apparatus.

FIG. 4B is an exploded view of a portion of an alternate embodiment of the surfacing apparatus 12 including the actuator assembly 28, the first gear assembly shaft 74A and the first trowel assembly 34A. In this embodiment, the pitch adjuster 162 includes the tightener 164, the adjuster plate 166 and a pitch actuator 168. The pitch actuator 168 causes rotation of the tightener 164, which moves the adjuster plate 166 toward or away from the trowel hub 58. In one embodiment, the pitch actuator 168 can be controlled by the controller 24 (illustrated in FIG. 1A, for example), which receives a command from the user via the remote control unit 14 (illustrated in FIG. 1A, for example). With this design, the user can remotely control the angle of the trowels 54 relative to the trowel hub 58 while the surfacing apparatus 12 is stationary or moving. Alternately, the pitch actuator 168 can be controlled directly by the remote control unit 14.

Figure 5:
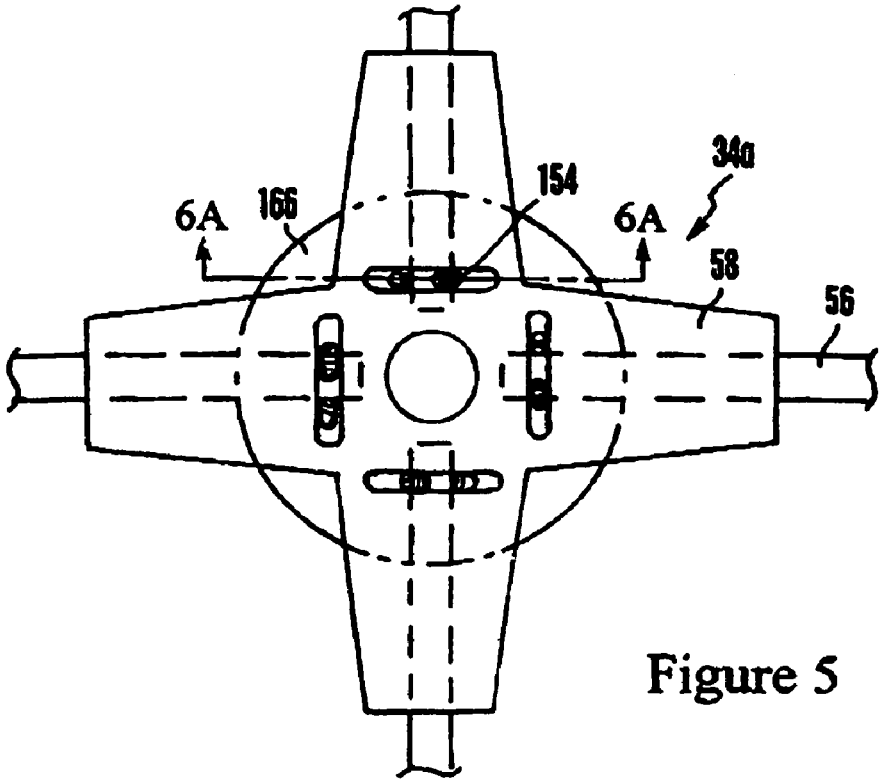
FIG. 5 is a bottom view of a portion of the trowel assembly.

FIG. 5 is a bottom view of a portion of the trowel assembly 34A illustrated in FIG. 4A, including the trowel hub 58, a portion of the trowel arms 56 (illustrated partially in phantom), the pitch regions 154 and the relative positioning of the adjuster plate 166 (illustrated partly in phantom).

Figure 6A:
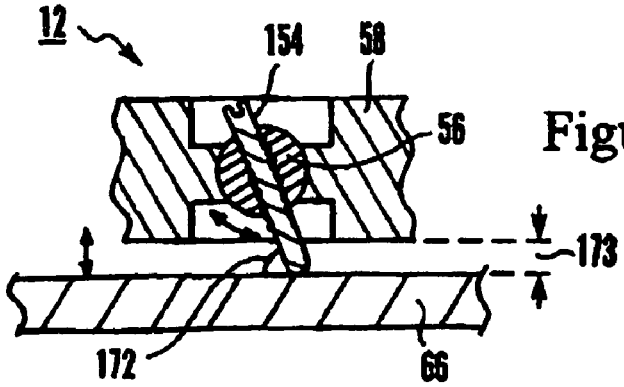
FIG. 6A is a cross-sectional view taken at line 6A-6A in FIG. 5 illustrating a portion of the trowel assembly in the first position.
Figure 6B:
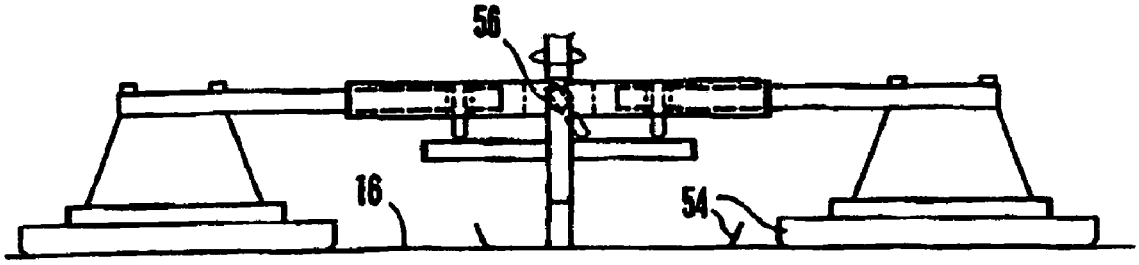
FIG. 6B is a side view of a portion of the trowel assembly in a first position.

FIG. 6A is a cross-sectional view taken on line 6A-6A of FIG. 5 when the adjuster plate 166 is in a first position relative to the trowel hub 58. In this example, the weight of the surfacing apparatus 12, and the positioning of the adjuster plate 166 causes the pitch region 154 to form a first pin angle 172 with the adjuster plate 166. When the adjuster plate 166 is at the first pin angle 172, the adjuster plate is positioned at a first distance 173 from the trowel hub 58. Further, at the first pin angle 172, the trowels 54 are substantially flat against the concrete surface 16, e.g. the trowel forms an angle with the concrete surface 16 that is approximately zero, as illustrated in FIG. 6B.

Figure 6C:
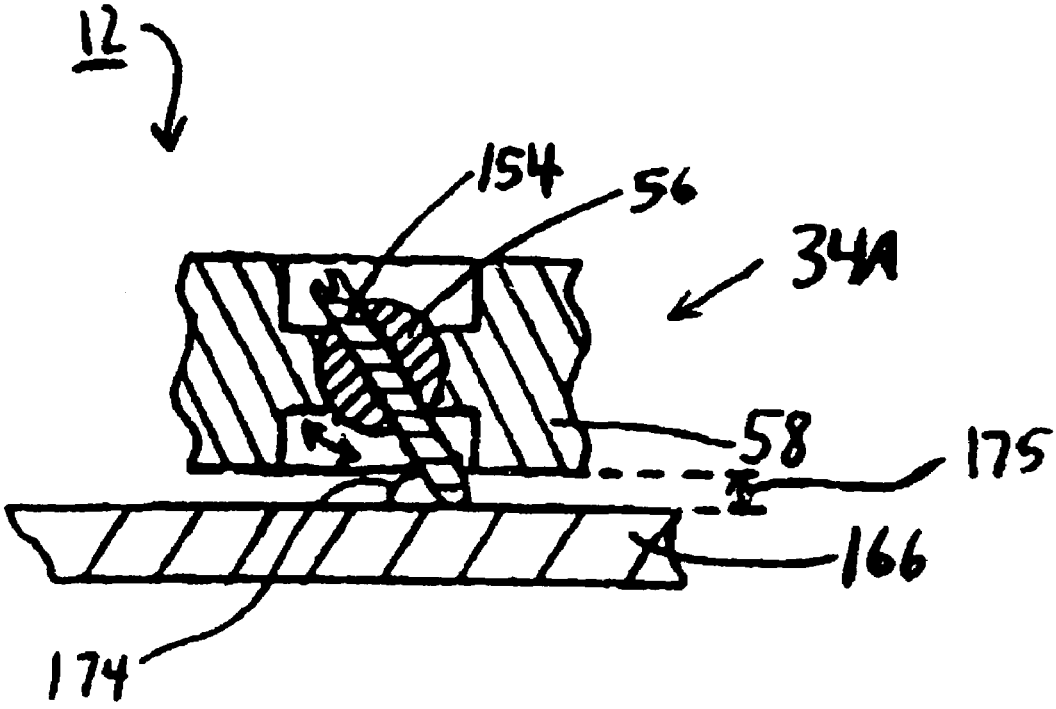
FIG. 6C is a cross-sectional view of a portion of the trowel assembly in the second position.
Figure 6D:
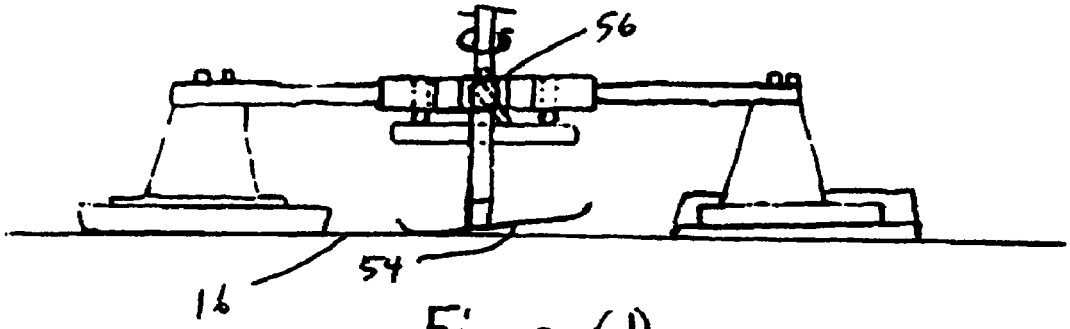
FIG. 6D is a side view of a portion of the trowel assembly in a second position.

FIG. 6C is a cross-sectional view of the same portion of the trowel assembly 34A illustrated in FIG. 6A. However, in FIG. 6C, the adjuster plate 166 is in a second position relative to the trowel hub 58, e.g. the adjuster plate 166 is at a distance 175 that is smaller than the distance 173 between the adjuster plate 166 and the trowel hub 58 when the adjuster plate is in the first position as illustrated in FIG. 6A. In this example, the pitch region 154 forms a more acute second pin angle 174 with the adjuster plate 166 than the pitch region 154 in FIG. 6A. As a result, the trowel arm 56 is forced to rotate so that the attached trowel 54 forms an angle with the concrete surface 16 that is greater than zero, as illustrated in FIG. 6D. It is recognized that the distance between the adjuster plate 166 and the trowel hub 58 can be any distance depending upon the design of the surfacing apparatus 12.

Further, the design of each trowel 54 can be such that surface area of the portion of the trowel 54 that is contacting the concrete surface is different depending upon the angle of the trowel 54 relative to the concrete surface.

With this design, by tightening or loosening the tightener 164 (illustrated in FIG. 4A), the angle that each trowel 54 forms with the concrete surface 16 can be simultaneously adjusted depending upon the conditions of the concrete. The pitch adjuster 162 provided herein can save the user time, and provides a manner to uniformly adjust the pitch of a plurality of trowels 54 depending upon the condition of the concrete and/or the environmental conditions. Consequently, a more consistent finish can be achieved on the concrete surface 16.

Figure 7A:
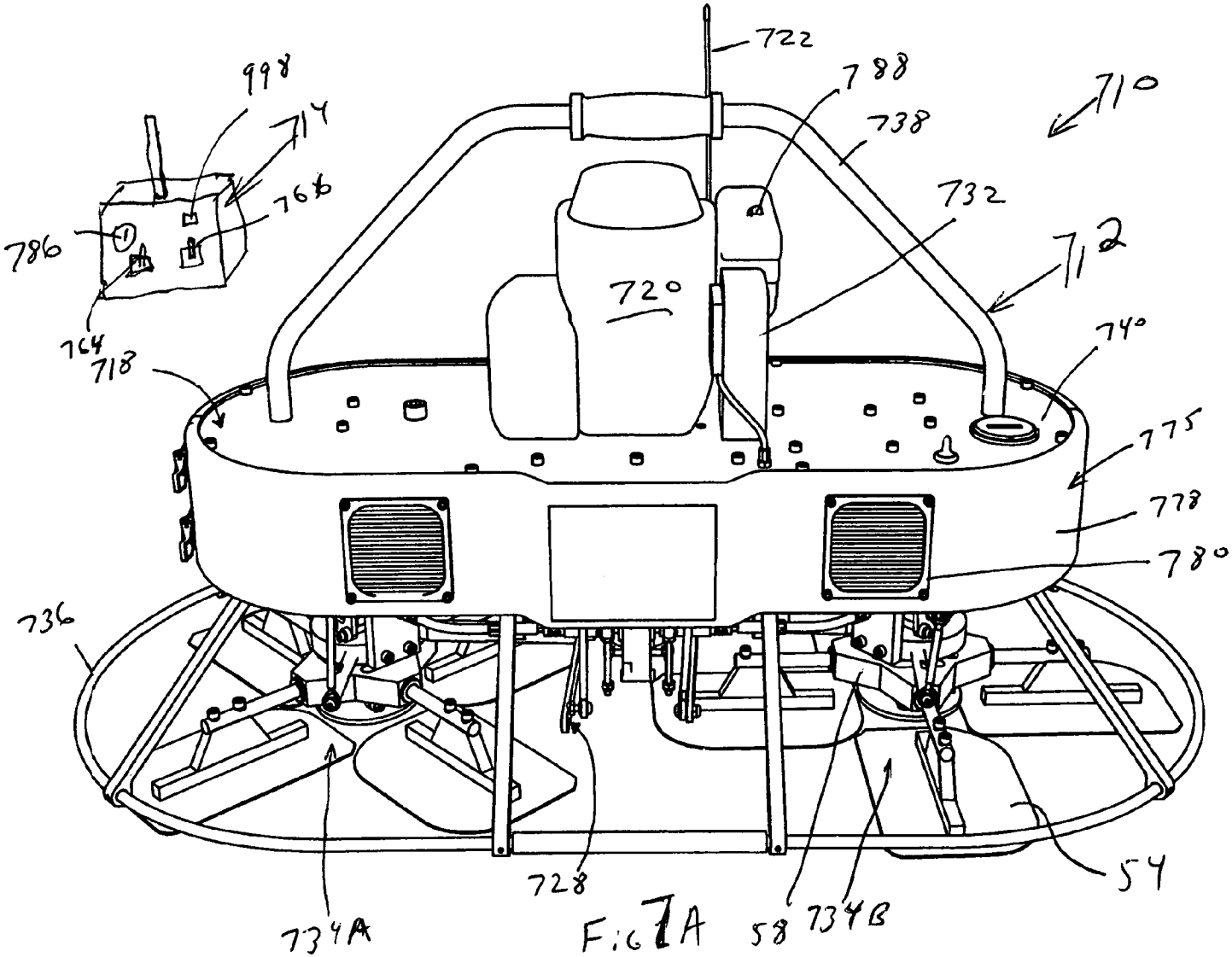
FIG. 7A is a perspective view of another embodiment of a concrete tool assembly having features of the present invention.
Figure 7B:
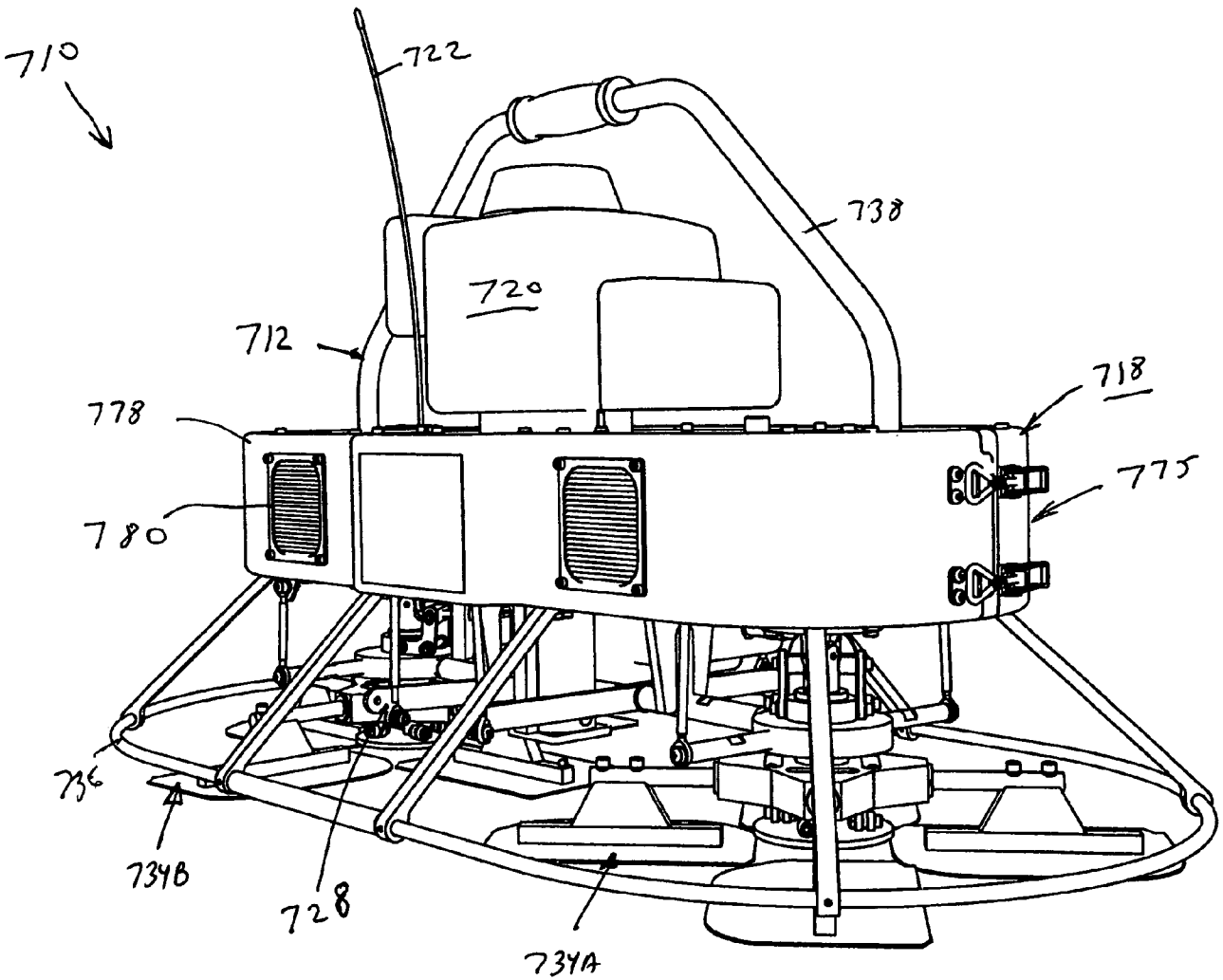
FIG. 7B is an alternative perspective view of the concrete tool assembly of FIG. 7A.

FIGS. 7A and 7B are alternative, perspective views of another embodiment of a concrete tool assembly 710 having features of the present invention, including a surfacing apparatus 712 and a remote control unit 714 (not illustrated in FIG. 7B). FIG. 7C is a perspective view of the surfacing apparatus 712 with a portion thereof removed. In this embodiment, movement and/or one or more functions of the surfacing apparatus 712 is again controlled by the remote control unit 714 and the surfacing apparatus 712 again receives signals from the remote control unit 714 to control movement of the surfacing apparatus 712 over the surface.

In FIGS. 7A-7C, the surfacing apparatus 712 and the remote control unit 714 are somewhat similar to the corresponding components described above and illustrated in FIG. 1A. More specifically, referring to FIGS. 7A-7C, in this embodiment, the surfacing apparatus 712 includes (i) a drive motor 720, a signal receiver 722, a controller 724, a gear assembly 726, one or more feedback devices 730, a power source 732, a trowel guard 736 and a handle 738 that are similar to the corresponding components described above, and (ii) a frame 718, one or more actuator assemblies 728, and one or more trowel assemblies including a first trowel assembly 734A and a second trowel assembly 734B that are slightly different than the corresponding components described above.

In this embodiment, the frame 718 again includes a top plate 740, a spaced apart bottom plate 742 and a plurality of plate supports 744 that are similar to the corresponding components described above. However, as illustrated in FIGS. 7A and 7B, the frame 718 additionally includes a shroud assembly 775 that conceals and/or protects one or more components of the surfacing apparatus 712. FIG. 7C illustrates the surfacing apparatus 712 with the shroud assembly 775 (not shown in FIG. 7C) removed.

More specifically, in one embodiment, the frame 718 defines a frame chamber 776 for receiving, concealing, and protecting one or more electrical and/or mechanical components of the surfacing apparatus 712. For example, the frame 718 inhibits fluid, dirt and debris from contacting the components positioned in the frame chamber 776. With this design, the reliability of the surfacing apparatus 712 is improved and the surfacing apparatus 712 can be easily washed, e.g. with a pressure washer, to clean cement from the surfacing apparatus 712. Further, in certain embodiments, the frame 718 can provide a controlled environment in the frame chamber 776 for one or more of the components positioned in the frame chamber 776. For example, one or more of the components positioned in the frame chamber 776 can be cooled with convection cooling.

The mechanical and/or electrical components positioned within and enclosed by the frame chamber 776 can be varied to according to the design of the surfacing apparatus 712. A non-exclusive listing of the components that are positioned within the frame cavity 776 include (i) mechanical components such as the gear assembly 726, including chains, gears, chain tensioners, drive shafts, clutches, one or more shafts, main shaft adapter, bearing blocks, bearings, and/or (ii) electronic components including the controller 724, actuators 750, one or more feedback devices 730, electrical isolators, a wiring assembly 767, and one or more switches.

In FIGS. 7A-7C, the shroud assembly 775 cooperates with the top plate 740 and the bottom plate 742 to define the frame chamber 776. The design of the shroud assembly 775 can be varied to suit the design requirements of the surfacing apparatus 712. In the embodiment illustrated in FIGS. 7A and 7B, the shroud assembly 775 includes a shroud 778 and one or more fans 780 that can be used to provide a controlled, clean environment in the frame chamber 776. Stated in another fashion, the shroud 778 and fans 780 can allow the surfacing apparatus 712 to be washed without damaging many of the components protected therein. Moreover, the shroud 778 and fans 780 can allow for cooling and controlling of the temperature of one or more of the components positioned therein.

FIG. 8 illustrates the shroud assembly 775 including the shroud 778 and the fans 780 in more detail. In this embodiment, the shroud 778 is generally oval tube shaped and is sized and shaped to encircle the plates 740, 742. In this embodiment, the shroud 778 includes a first shroud section 782A, a second shroud section 782B, a first connector 782C, and a spaced apart second connector 782D. In this embodiment, the first connector 782C is a hinge that pivotable connects a first end of each shroud section 782A, 782B, and the second connector 782D is a pair of spaced apart latches that selectively secures a second end of each shroud section 782A, 782B together. With this design, the latches can be undone and the shroud sections 782A, 782B pivoted to remove the shroud 778 and the fans 780 from the rest of the frame 718.

Additionally, the shroud assembly 775 can include a fan electrical connector (not shown) that selectively, electrically connects the fans 780 to the electrical system of the surfacing apparatus 712. With this design, the fans 780 can be electrically disconnected when the shroud assembly 775 is removed from the frame 718. This provides easy access to the components within the frame chamber 776.

The fans 780 provide a controlled environment for the components within the frame chamber 776. The number of fans 780 utilized can vary. In one embodiment, the shroud assembly 775 includes four fans 780 that are positioned in apertures in the shroud 778 and are secured to the shroud 778. For example, each fan 780 can be a 92 mm fan. In one embodiment, two of the fans 780 move cool air into the frame chamber 776 and the other two fans 780 move the hot air out of the frame chamber. In one embodiment, each of the fans 780 is a sealed fan that inhibits the flow of water through the fan 780 when the fan 780 is not on.

Referring back to FIG. 7C, in one embodiment, the frame 718 also includes one or more chamber fans 784 that are mounted within the frame chamber 776 and that move air across one or more components positioned in the frame chamber 776. For example, the frame 718 can include two chamber fans 784 that move air across one or more of the electrical and mechanical components. For example, each of the chamber fans 784 can be a 80 mm fan.

Referring back to FIGS. 7A-7C, each actuator assembly 728 interacts with one or more of the trowel assemblies 734A, 734B to alter the angle of each trowel assembly 734A, 734B relative to the surface. In FIGS. 7A-7C, the surfacing apparatus 712 includes three actuator assemblies 728 that each includes one or more actuators 750 and one or more arm assemblies. In this embodiment, the actuator assemblies 728 can move the trowel assemblies 734A, 734B to cause controlled movement of the surfacing apparatus 712 forward, backward, left, and right and rotate the surfacing apparatus 712 clockwise and counter clockwise.

The power source 732 can include a generator that can provide power to the controller 724, the actuator assemblies 728, the feedback devices 730 and any other component that requires a power.

The remote control unit 714 sends signals to the signal receiver 722 for controlling movement of the surfacing apparatus 712. In the embodiment illustrated in FIG. 7A, 7B, the remote control unit 714 is a radio controlled device that includes (i) a first control 764 that controls the operational speed of the drive motor 720 and side-to-side directional movement of the surfacing apparatus 712, and (ii) a second control 766 that controls forward, backward and rotational movement of the surfacing apparatus 712. For example, movement of the first control 764 forward and backward will increase/decrease the operational speed of the drive motor 720. Further, side to side movement of the first control 764 will cause side to side movement of the surfacing apparatus 712. Moreover, movement of the second control 766 forward or backward will move the surfacing apparatus 712 forward or backward and side to side movement of the second control 766 will cause counter clockwise or clockwise rotation of the surfacing apparatus 712.

Further, the remote control unit 714 can include additional controls and/or readout information. For instance, the remote control unit 714 can include a fuel gauge readout 786 that receives information from a fuel sensor 788. With this design, the amount of fuel in the fuel tank can be easily monitored.

Figure 9A:
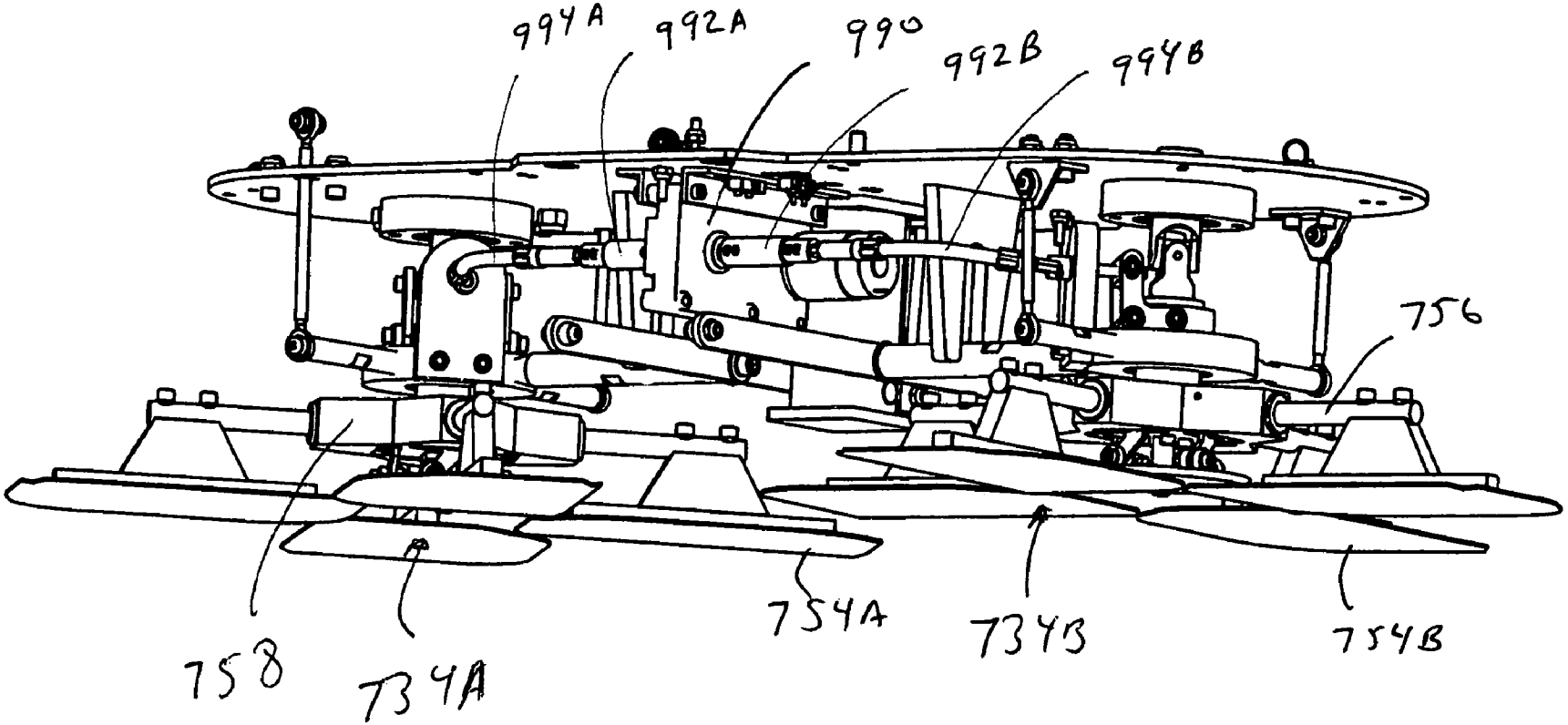
FIG. 9A is a perspective view of a portion of the concrete tool assembly of FIG. 7A.
Figure 9B:
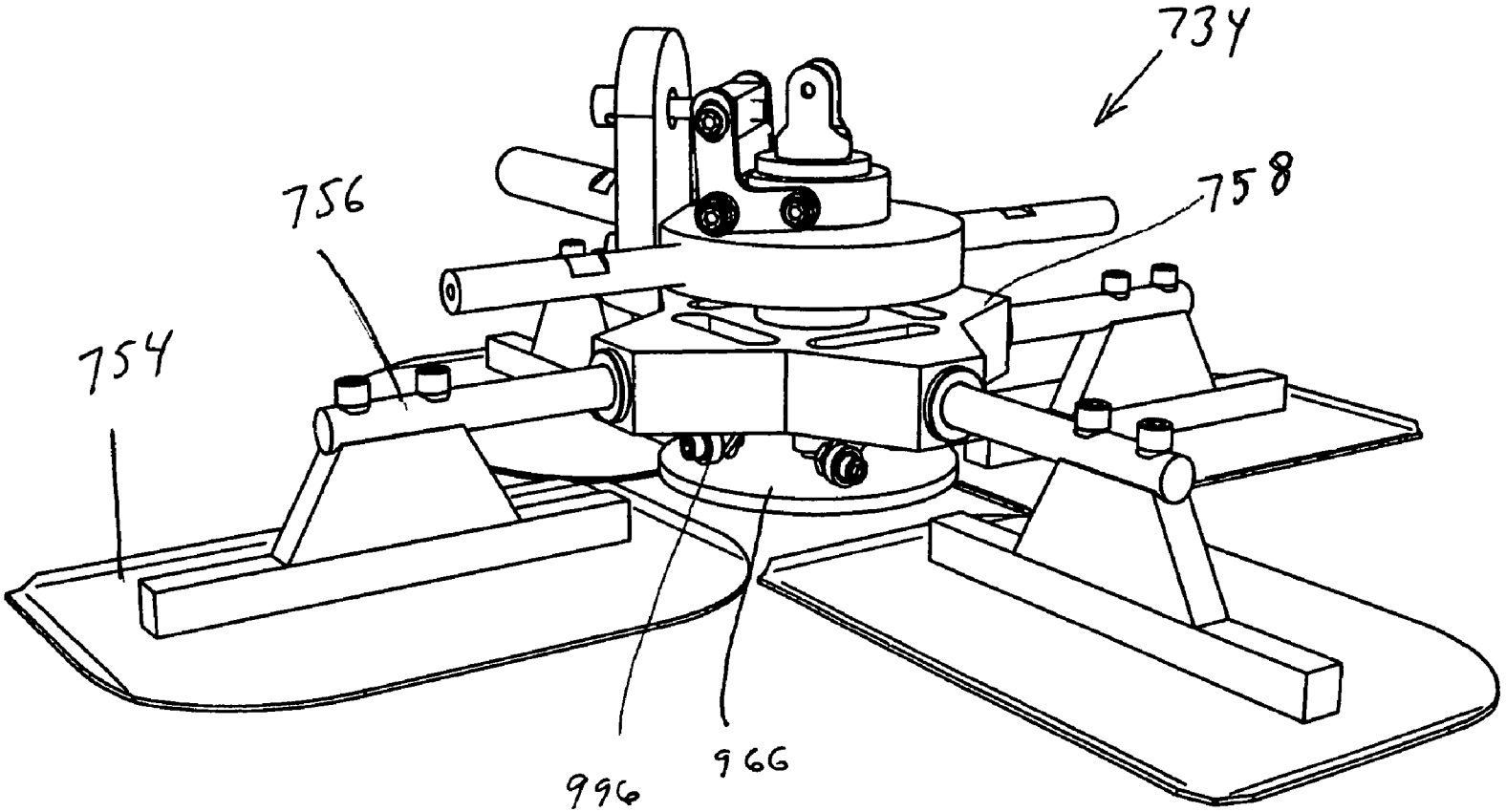
FIG. 9B is a perspective view of a portion of the concrete tool assembly of FIG. 7A.

FIGS. 9A-9C illustrate the trowels assemblies 734A, 734B in more detail. In this embodiment, the first trowel assembly 734A includes four first trowels 754A and the second trowel assembly 734B includes four second trowels 754B that are similar to the corresponding components described above.

Additionally, each of the trowel assemblies 734A, 734B includes a trowel hub 758 and plurality of trowel arms 756 that secure the respective trowels 754A, 754B to the respective trowel hub 758. For the first trowel assembly 734A, the trowel hub 758 rotatably couples the first trowels 754A to the gear assembly. Similarly, for the second trowel assembly 734B, the trowel hub 758 rotatably couples the second trowels 754B to the gear assembly.

The entire trowel assemblies 734A, 734B can be angled relative to the surface, as described previously to move the surfacing apparatus along the surface. Additionally, each of the trowels 754A, 754B can be pitched, e.g. angled, relative to the respective trowel hub 758 and the surface, collectively, as provided below. By pitching the trowels 754A, 754B relative to the trowel hub 58, the number of pounds of force per square inch experienced by the surface for each trowel can be increased or decreased. With this design, the surfacing apparatus can be used with concrete at various stages in the curing process, and with different mixtures of concrete. For example, concrete that is drier may require a greater trowel pitch than concrete that has a higher moisture content. As a further example, the trowel pitch can be decreased, e.g. flattened relative to the concrete surface, for concrete having a higher than normal water to cement ratio, thereby increasing finishing quality and efficiency.

In one embodiment, a single pitch mover 990 can be used to remotely adjust the pitch of all of the first trowels 754A and all of the second trowels 754B at approximately the same time and approximately the same rate. The single pitch mover 990 provided herein can save the user time, and provides a manner to uniformly adjust the pitch of all of the first trowels 990 and the second trowels 990 depending upon the condition of the concrete and/or the environmental conditions. Consequently, in certain embodiments, a more consistent finish can be achieved on the concrete surface and the surfacing apparatus is easier to control.

In one embodiment, the pitch mover 990 includes a gear type motor that includes a first mover output 992A that is coupled with a first flexible drive 994A to the first trowel assembly 734A, and a second mover output 992B that is coupled with a second flexible drive 994B to the second trowel assembly 734B.

In one embodiment, the single pitch mover 990 can be remotely controlled by a pitch switch 998 (illustrated in FIG. 7A) on the remote control unit 714. With this design, the user can remotely control the angle of the trowels 754A, 754B relative to the trowel hub 758 while the surfacing apparatus is stationary or moving.

FIGS. 9B and 9C illustrate one of the trowel assemblies 734 in more detail. In this embodiment, the trowel assembly 734 includes the trowel hub 758, four trowel arms 756 and four trowels 754. The trowel hub 758 includes a central hub aperture and four hub slots. Each trowel arm 756 extends into, cantilevers away from, and is rotatably secured to the trowel hub 758.

The trowel assembly 734 also includes an adjuster plate 966 that is mechanically coupled to the pitch mover 990 (illustrated in FIG. 9A). With this design, the pitch mover 990 can selectively move the adjuster plate 966 up and down relative to the trowel hub 758. In this embodiment, the adjuster plate 966 contacts a contact area 996 at a proximal end of each of the trowel arms 756. With this design, movement of the adjuster plate 966 up and down causes the rotation of the trowel arms 756 and rotation (pitching) of the trowels 754. Stated in another fashion, movement of the adjuster plate 966 along a first axis causes rotation of the trowels 754 about a second axis.

In one embodiment, the contact area 996 of each of the trowel arms 756 can include a roller type bearing that engages the adjuster plate 966 to allow for smooth motion of the trowel arms 756 and to reduce wear on the adjuster plate 966 and/or the contact area 996.

While the particular concrete tool assembly 10 as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A concrete tool assembly used on a surface, the concrete tool assembly comprising:

a surfacing apparatus including (i) a frame, (ii) a first trowel assembly that is movably coupled to the frame, the first trowel assembly including a plurality of first trowels, (iii) a second trowel assembly that is movably coupled to the frame, the second trowel assembly including a plurality of second trowels, and (iv) a pitch mover that adjusts the pitch of the first trowels and the pitch of the second trowels relative to the surface at approximately the same time; wherein the pitch mover includes (a) a first output that is coupled to all of the plurality of first trowels with a first adjuster, (b) a second output that is coupled to all of the plurality of second trowels with a second adjuster, and (c) a motor that moves both outputs concurrently, wherein the movement of the first output causes the first adjuster to move and the pitch of all of the plurality of first trowels to be concurrently adjusted, and wherein the movement of the second output causes the second adjuster to move and the pitch of all of the plurality of second trowels to be concurrently adjusted.

2. The concrete tool assembly of claim 1 wherein the pitch mover adjusts the pitch to the first trowels and the pitch of the second trowels at approximately the same rate.

3. The concrete tool assembly of claim 1 wherein the first trowel assembly includes a first hub and the first trowels extend away from the first hub, wherein the second trowel assembly includes a second hub and the second trowels extend away from the second hub, and wherein pitch mover rotates the first trowels relative to the first hub and the second trowels relative to the second hub.

4. The concrete tool assembly of claim 1 wherein at least one of the first trowels is coupled to a roller contact that engages the first adjuster.

5. The concrete tool assembly of claim 4 wherein movement of the first adjuster along a first axis causes rotation of one of the first trowels about a second axis.

6. The concrete tool assembly of claim 1 wherein the motor rotates both outputs at the same rate.

7. The concrete tool assembly of claim 1 further comprising a remote control unit that includes a pitch control that is moved to remotely control the pitch mover to adjust the pitch of the first trowels and the second trowels.

8. The concrete tool assembly of claim 1 wherein the surfacing apparatus includes an actuator assembly that moves a portion of the first trowel assembly and a portion of the second trowel assembly to control movement of the surfacing apparatus along the surface.

9. A remotely controlled concrete tool assembly used on a surface, the concrete tool assembly comprising:

a surfacing apparatus comprising: (i) a frame; (ii) a first shaft including a first shaft section, a second shaft section, and a pivot that connects the shaft sections together and allows for the second shaft section to pivot relative to the first shaft section; (iii) a bearing assembly that couples the first shaft section to the frame, the bearing assembly allowing the first shaft section to rotate relative to the frame; (iv) a drive motor that rotates the first shaft relative to the frame; (v) a first trowel assembly that includes (a) a first trowel hub that is coupled to the second shaft section of the first shaft, (b) a plurality of first trowels that are secured to and extend away from the first trowel hub, each of the first trowels including a first roller contact, (c) a first adjuster plate that engages the first roller contact of each of the plurality of first trowels, wherein movement of the first adjuster plate relative to the first trowel hub causes the first roller contact of each of the first trowels to move and each of the first trowels to rotate relative to the first trowel hub and the pitch of each of the first trowels relative to the surface to change to alter the surface area of each first trowel that contacts the surface; and (d) a pitch actuator that moves the adjuster plate relative to the first trowel hub; and (vi) an actuator assembly that pivots the second shaft section and the first trowel assembly relative to the first shaft section to cause movement of the surfacing apparatus relative to the surface; and a remote control unit that sends a signal to the surfacing apparatus to remotely control the actuator assembly and the pitch actuator, the remote control unit being mechanically isolated from the surfacing apparatus, wherein the signal to the pitch actuator causes the pitch actuator to move the adjuster plate to adjust the pitch of the first trowels concurrently.

10. The remotely controlled concrete tool assembly of claim 9 wherein the surfacing apparatus further comprising a second trowel assembly that includes (a) a second trowel hub, (b) a plurality of second trowels that are secured to and extend away from the second trowel hub, each of the second trowels including a second roller contact, (c) a second adjuster plate that engages the second roller contact of each of the plurality of second trowels, wherein movement of the second adjuster plate relative to the second trowel hub causes the second roller contact of each of the second trowels to move and each of the second trowels to rotate relative to the second trowel hub and the pitch of each of the second trowels relative to the surface to change to alter the surface area of each second trowel that contacts the surface.

11. The remotely controlled concrete tool assembly of claim 10 wherein the pitch mover includes a first output, a second output, and a motor that rotates both outputs at the same rate, and wherein the first trowels are coupled to the first output and the second trowels are coupled to the second output.

12. A concrete tool assembly used on a surface, the concrete tool assembly comprising:

a surfacing apparatus including (i) a frame, (ii) a first trowel assembly that is movably coupled to the frame, the first trowel assembly including a first adjuster plate that is rotatably coupled to the frame, a first trowel hub, and a plurality of first trowels, wherein each of the first trowels includes a first trowel arm that secures the respective first trowel to the first trowel hub, and a first roller contact that engages the first adjuster plate, and (iii) a pitch mover coupled to the first adjuster plate that moves the first adjuster plate up and down to concurrently move the roller contact of each of the first trowels and concurrently adjust the pitch of the first trowels, wherein the pitch mover includes a first output that is coupled to the first adjuster plate, and a motor that moves the first output to move the first adjuster plate relative to the first trowel hub.

13. The concrete tool assembly of claim 12 wherein first trowel arm is rotatably coupled to the first trowel hub, and wherein the first roller contact is secured to a proximal end of the first trowel arm.

14. The concrete tool assembly of claim 12 further comprising a second trowel assembly that is movably coupled to the frame, the second trowel assembly including a second adjuster plate that is rotatably coupled to the frame, a plurality of second trowels, and a second roller contact that engages the second adjuster plate and that is coupled to one of the second trowels.

15. The concrete tool assembly of claim 14 wherein a second output that is coupled to the second adjuster plate, and a motor that moves both outputs at the same rate.

16. The concrete tool assembly of claim 15 wherein the motor rotates both outputs to move the adjuster plates at the same rate.

17. The concrete tool assembly of claim 12 further comprising a remote control unit that includes a pitch control that is moved to remotely control the pitch mover to adjust the pitch of the first trowels.

* * * * *